US011241048B2

(12) United States Patent
Alva

(10) Patent No.: US 11,241,048 B2
(45) Date of Patent: Feb. 8, 2022

(54) GARMENTS FOR NURSING OR FOR HANDS-FREE USE OF A BREAST PUMP

(71) Applicant: Rumina Nursingwear, Marina, CA (US)

(72) Inventor: Dawn Michele Alva, Marina, CA (US)

(73) Assignee: Rumina Nursingwear, Marina, CA (US)

( * ) Notice: Subject to any disclaimer, the term of this patent is extended or adjusted under 35 U.S.C. 154(b) by 762 days.

(21) Appl. No.: 15/295,989

(22) Filed: Oct. 17, 2016

(65) Prior Publication Data

US 2018/0103691 A1 Apr. 19, 2018

(51) Int. Cl.
*A41C 3/04* (2006.01)
*A41C 3/00* (2006.01)

(52) U.S. Cl.
CPC ..... *A41C 3/04* (2013.01); *A41C 3/0035* (2013.01)

(58) Field of Classification Search
CPC ..... A41C 3/0035; A41C 3/04; A41C 3/0021; A41C 3/0028; A41C 3/0071; A41C 3/0092; A41C 3/0064; A41D 27/24; A41D 2300/24; A41D 2300/50; A41D 1/215; A41F 15/002
USPC ..... 450/36, 59, 60, 61, 63, 65, 67, 18, 86, 450/37, 58
See application file for complete search history.

(56) References Cited

U.S. PATENT DOCUMENTS 155,720 A 10/1874 Gray et al.
238,945 A 3/1881 Marks
277,744 A 5/1883 Kimball
614,068 A 11/1898 Wetzler
684,078 A 10/1901 Martin
686,699 A 11/1901 Bandler
949,414 A 2/1910 Cuningham
1,136,727 A 4/1915 Smith
1,189,589 A 7/1916 Lawrence
1,371,841 A 3/1921 Berkwits
1,509,226 A 9/1924 Brown
1,670,610 A 5/1928 Colby
(Continued)

FOREIGN PATENT DOCUMENTS

AU 2006200947 A1 9/2006
CN 2621444 Y 6/2004
(Continued)

OTHER PUBLICATIONS

LinguaLinx Language Solutions, Inc., Mar. 2021, Translation of CN 204930423 U original publication date Jan. 6, 2016 (Translated into English Mar. 2021).*
(Continued)

*Primary Examiner* — Jocelyn Bravo
(74) *Attorney, Agent, or Firm* — TraskBritt

(57) ABSTRACT

Garments configured to enable hands-free breast pumping using a breast pump and to enable direct nursing, include brassiere cups having a plurality of at least partially overlapping material components. Each component may define a free edge along a portion of its periphery and may be seamless interior of its periphery. The funnel of a breast pump may be received under and behind free edges of the components, and the free edges may provide support to the funnel while the breast pump is used for milk expression. One of the components also provides a side support during direct nursing.

19 Claims, 12 Drawing Sheets

(56) References Cited

U.S. PATENT DOCUMENTS 1,849,514 A 3/1932 Edelmann
2,075,656 A 3/1937 Paternayan
2,236,142 A 3/1941 Kaupp
2,298,361 A 10/1942 Freund
2,425,145 A * 8/1947 Coleman ..... A41C 3/00 450/92
2,436,430 A 2/1948 Hart
2,440,466 A 4/1948 Freedman
2,452,345 A 10/1948 Anselmo
2,485,313 A 10/1949 Rabinowitz
2,486,836 A 11/1949 Garson
2,492,862 A 12/1949 Harvey
2,498,487 A 2/1950 Elias
2,501,860 A 3/1950 Becker
2,585,338 A 2/1952 Meares
2,611,130 A 9/1952 Engelman
2,613,355 A 10/1952 Coleman
D170,509 S 9/1953 Peck
2,679,048 A 5/1954 Alberts
2,711,539 A 6/1955 Loscher
2,715,225 A 8/1955 Gould
2,890,702 A 6/1959 Farino
2,925,816 A 2/1960 Rosenthal
2,928,396 A 3/1960 O'Dell
3,002,515 A 10/1961 Glogover
3,145,714 A 8/1964 Brown
3,306,299 A 2/1967 Paramore
3,516,415 A 6/1970 Hadley-Webb
3,524,449 A 8/1970 Peters
3,746,007 A 7/1973 Hand et al.
3,746,008 A 7/1973 LoCascio et al.
3,763,865 A 10/1973 DeFru
3,773,052 A 11/1973 Belardinelli
3,780,741 A 12/1973 Cole
3,782,385 A 1/1974 Loyd
3,834,397 A 9/1974 Birch
3,840,012 A 10/1974 Rushton, Jr.
3,873,403 A * 3/1975 Edelman ..... A41F 15/005 428/111
3,890,978 A 6/1975 Nobbs
3,931,816 A 1/1976 Waldmann
4,004,294 A 1/1977 Pinch
4,263,912 A 4/1981 Adams
4,270,538 A 6/1981 Murphy
4,335,728 A 6/1982 Fildan
4,355,641 A 10/1982 Dastoli et al.
4,390,024 A 6/1983 Williams
4,393,875 A 7/1983 O'Boyle et al.
4,411,269 A 10/1983 Weintraub
4,423,734 A 1/1984 Schawel
4,453,549 A 6/1984 DiTullio
4,550,734 A 11/1985 Porco
4,584,992 A 4/1986 Liu
4,633,876 A 1/1987 Scullin
4,640,287 A 2/1987 Anderson et al.
4,673,388 A 6/1987 Schlensog et al.
4,697,592 A 10/1987 Maddux et al.
4,713,842 A 12/1987 Patterson
4,857,051 A 8/1989 Larsson
4,878,879 A 11/1989 Kunstadter
4,892,517 A 1/1990 Yuan et al.
4,911,677 A 3/1990 White
4,929,229 A 5/1990 Larsson
4,956,878 A 9/1990 Boynton
5,009,638 A 4/1991 Riedweg et al.
5,024,628 A 6/1991 Sanchez
5,032,104 A 7/1991 Rainville
5,038,411 A 8/1991 St. Armand
5,045,019 A 9/1991 Capasso et al.
5,049,126 A 9/1991 Larsson
D321,273 S 11/1991 Hull
5,071,403 A 12/1991 Larsson
5,090,059 A 2/1992 Kahl
5,092,812 A 3/1992 Babcock
5,094,647 A 3/1992 Courtney
5,167,566 A 12/1992 Novitsky et al.
5,180,326 A 1/1993 Williams
5,278,998 A 1/1994 Book
5,295,957 A 3/1994 Aida et al.
5,309,572 A 5/1994 Seamans
5,358,476 A 10/1994 Wilson
5,380,238 A 1/1995 Crew-Gee
5,415,632 A 5/1995 Samson
D366,351 S 1/1996 Winchell
5,514,166 A 5/1996 Silver et al.
5,571,084 A 11/1996 Palmer
5,575,768 A 11/1996 Lockridge et al.
5,616,125 A 4/1997 Jelks
5,660,577 A 8/1997 Modena
5,664,257 A 9/1997 Hall
5,697,830 A 12/1997 White
5,720,722 A 2/1998 Lockridge
5,823,851 A 10/1998 Dicker
5,941,847 A 8/1999 Huber et al.
5,954,690 A 9/1999 Larsson
6,004,186 A 12/1999 Penny
6,027,396 A 2/2000 Yonchar
6,083,079 A 7/2000 Pearson
6,178,784 B1 1/2001 Marley, Jr.
6,213,840 B1 4/2001 Han
6,227,936 B1 5/2001 Mendoza
6,247,996 B1 6/2001 Fields
D446,629 S 8/2001 Swanger
6,346,027 B1 2/2002 Merkovsky
6,364,741 B1 4/2002 Ferguson
6,379,327 B2 4/2002 Lundy
6,440,100 B1 8/2002 Prentiss
6,575,202 B2 6/2003 Lafond
6,652,484 B1 11/2003 Hunckler et al.
6,659,841 B2 12/2003 Raimondo
6,706,012 B2 3/2004 McKendry et al.
6,764,377 B2 7/2004 Gillan
6,821,185 B1 11/2004 Francis
6,854,132 B1 2/2005 Polzin
6,855,029 B2 2/2005 Rothman
6,866,558 B2 3/2005 Luciano et al.
6,887,217 B1 5/2005 Logan
6,896,581 B2 5/2005 Otto
6,974,361 B2 12/2005 Cravaack et al.
6,983,489 B2 1/2006 Caprio
7,076,809 B2 7/2006 Rothman
7,081,034 B1 7/2006 Zoellner
7,094,217 B2 8/2006 Fialkoff
7,128,877 B2 10/2006 Quay et al.
7,223,255 B2 5/2007 Myers et al.
7,306,505 B2 12/2007 Barbour et al.
7,435,155 B2 10/2008 Reinisch et al.
7,448,936 B1 11/2008 Kemp-Dorsey
7,559,915 B2 7/2009 Dao et al.
7,695,343 B2 4/2010 Nobbs
8,137,153 B2 3/2012 Bell
8,192,247 B2 6/2012 Abbaszadeh
8,307,463 B2 11/2012 Ritchie
8,323,070 B2 12/2012 Abbaszadeh
8,414,353 B1 4/2013 Leavell
8,469,769 B2 6/2013 Hendrickson
8,469,770 B2 6/2013 Alva
8,657,643 B2 2/2014 Perez
8,668,547 B2 3/2014 Boonen et al.
9,155,339 B2 10/2015 Alva
9,629,396 B2 4/2017 Alva
2002/0022433 A1 2/2002 Yeung et al.
2002/0193731 A1 12/2002 Myers et al.
2003/0167037 A1* 9/2003 Fialkoff ..... A41C 3/04 604/74
2003/0186617 A1* 10/2003 Sorensen ..... A41C 3/04 450/37
2003/0191427 A1 10/2003 Jay et al.
2005/0159701 A1 7/2005 Conaway
2005/0198726 A1* 9/2005 Yadav ..... A41D 13/02 2/455
2006/0111664 A1 5/2006 Samson et al.
2007/0161330 A1 7/2007 Whitehead et al.
2007/0271675 A1 11/2007 Eraca

(56) References Cited

U.S. PATENT DOCUMENTS

| | | | | |
|---|---|---|---|---|
| 2008/0039781 | A1 | 2/2008 | Bjorge | |
| 2008/0064299 | A1 | 3/2008 | La Fontaine | |
| 2009/0265830 | A1 | 10/2009 | Hendrickson | |
| 2010/0159802 | A1 | 6/2010 | Abbaszadeh | |
| 2010/0261410 | A1* | 10/2010 | Hirtz | A41C 3/04 450/36 |
| 2011/0092134 | A1* | 4/2011 | Alva | A41C 3/04 450/36 |
| 2011/0239702 | A1 | 10/2011 | Best et al. | |
| 2011/0281497 | A1 | 11/2011 | Van Dorp et al. | |
| 2011/0314587 | A1 | 12/2011 | Ritchie | |
| 2012/0129427 | A1* | 5/2012 | Perez | A41C 3/0035 450/36 |
| 2012/0184179 | A1 | 7/2012 | Blitz | |
| 2012/0185992 | A1 | 7/2012 | Byrnes | |
| 2012/0197187 | A1 | 8/2012 | LaFave | |
| 2012/0277636 | A1 | 11/2012 | Blondheim et al. | |
| 2012/0309264 | A1 | 12/2012 | Kubik | |
| 2013/0095727 | A1 | 4/2013 | Abbaszadeh | |
| 2013/0122780 | A1* | 5/2013 | McCall | A41C 3/0028 450/30 |
| 2014/0220860 | A1 | 8/2014 | Alva | |
| 2014/0364035 | A1 | 12/2014 | Abbaszadeh | |
| 2014/0364036 | A1 | 12/2014 | Abbaszadeh | |
| 2015/0133028 | A1 | 5/2015 | Applewhite | |
| 2015/0143605 | A1 | 5/2015 | Cobb | |
| 2016/0007659 | A1 | 1/2016 | Blacker | |
| 2016/0015092 | A1 | 1/2016 | Abbaszadeh | |
| 2017/0042256 | A1* | 2/2017 | Kawasaki | A41C 3/02 |

FOREIGN PATENT DOCUMENTS

| | | | |
|---|---|---|---|
| CN | 201774989 | U | 3/2011 |
| CN | 202197855 | U | 4/2012 |
| CN | 104351960 | A | 2/2015 |
| CN | 204635103 | U | 9/2015 |
| CN | 204930423 | U | 1/2016 |
| CN | 205358264 | U | 7/2016 |
| DE | 584456 | C | 9/1933 |
| EP | 152213 | A1 | 1/1997 |
| EP | 941674 | A1 | 9/1999 |
| FR | 1004058 | A | 3/1952 |
| GB | 2287640 | A | 9/1995 |
| WO | 9953780 | A1 | 10/1999 |
| WO | 2009134274 | A1 | 11/2009 |
| WO | 2010070042 | A1 | 6/2010 |
| WO | 2010080122 | A1 | 7/2010 |
| WO | 2012172437 | A2 | 12/2012 |
| WO | 2013180644 | A1 | 12/2013 |

OTHER PUBLICATIONS

The first Notification of Making Rectification for Chinese Application No. 201720903699.1, (dated Jan. 3, 2018), 3 pages including translation.

Decker, C., "Hands-free Breast Pumping Tip," babylovesyourmilk.com, (last modified Jun. 4, 2010), http://babylovesyourmilk.com/hands-free-breast-pumping.php, 4 pages.

"Nourish by BeliBea," Belibea, http://web.archive.org/web/20150121222132/http://belibea.com/product/nourish-by-belibea/, (archived Jan. 21, 2015), 2 pages.

Chinese Office Action for Chinese Application No. 201710607355, dated Jul. 1, 2020, 25 pages with translation.

Chinese Second Office Action for Chinese Application No. 201710607355.0, dated Feb. 20, 2021, 28 pages.

Chinese Third Office Action for Chinese Application No. 201710607355.0, dated Aug. 6, 2021, 24 pages with translation.

* cited by examiner

GARMENTS FOR NURSING OR FOR HANDS-FREE USE OF A BREAST PUMP

TECHNICAL FIELD

The present disclosure, in various embodiments, relates generally to apparel worn by a nursing woman. More particularly, this disclosure relates to a garment configured to accommodate a woman's use of a breast pump and configured to allow direct nursing of an infant.

BACKGROUND

Because of the increased awareness of the health benefits of breastfeeding for both infant and mother, many women are finding ways to provide their infants with breast milk even if the mothers are not physically present during the delivery of the milk to the infants or not physically able to directly breastfeed their infants. To do this, typically, a woman will express milk using a manual or electric breast pump device that has a funnel. The funnel is placed over the nipple of the breast, and suction is applied by the breast pump to encourage expression of milk from the nipple. A conventional electronic breast pump includes the funnel, a motor to generate the suction for the expression of milk, and a reservoir connected to the funnel to receive the expressed milk. Because of the duration and frequency required for breast milk expression, a woman may express both breasts simultaneously to increase efficiency. This process is often uncomfortable and time consuming. Further, without additional support, the funnel of a conventional breast pump often will not remain over the nipple on the breast; therefore, use of the pump often inhibits the woman from concurrently performing other activities.

Efforts have been made to design brassieres, or other garments, that may be configured for use with a breast pump, which brassieres or other garments are referred to herein as "pumping brassieres" or "pumping garments," respectively. These designs are often uncomfortable and cumbersome for the nursing woman. Often, the conventional pumping garments include various attachments to secure the funnel of the breast pump to the wearer's breast. For example, elastic bands, slings, hooks, buttons, and the like may be used. Some conventional pumping garments require additional devices or fabric pieces to be added or detached before the funnel can be secured. For example, U.S. Pat. No. 7,094,217, issued Aug. 22, 2006, describes the use of an elastic band to secure the funnel of the pump and the use of a latch to secure portions of the pumping brassiere when the wearer is not expressing milk.

Many conventional pumping garments are not designed to be worn for an extended length of time, but rather, essentially only while the wearer is expressing milk. Often, donning such pumping garments or attaching breast pumps, for the time of nursing, requires at least partially disrobing or at least partial exposure of the breast. For example, U.S. Pat. No. 6,004,186, issued Dec. 21, 1999, describes a garment (e.g., a halter top, a bandeau, a tube top) that the woman wears to secure a funnel of a breast pump to her breast. Breast pump funnels may be inserted into two openings in a central area of each side of the garment.

Conventional pumping brassieres also may not be configured to accommodate attachment and detachment of breast pump funnels while the woman is wearing the brassiere, may not accommodate or support the natural expansion and contraction of a nursing woman's breasts, and may not be designed to accommodate both direct nursing of an infant and pumping of breast milk with a breast pump.

Where efforts have been made to design pumping brassieres that also accommodate direct nursing of an infant, the brassieres may include support straps with selectively releasable clasps configured to selectively connect a shoulder strap to material of a cup of the brassiere. For example, U.S. Pat. No. 8,469,770, issued Jun. 25, 2013, describes such a brassiere. The support strap is interior to the cup materials, and the support strap is worn against the skin when the pumping brassiere is worn. Thus, the pumping brassiere includes not only the material of the cups, configured to accommodate pumping, but also an additional support strap to accommodate nursing. Designing pumping brassieres that also accommodate nursing, while keeping the designs simple, non-cumbersome, comfortable, and not bulky has continued to present a challenge.

Further, conventional pumping brassieres often include seams, tacking, or other stitching at points within the cups of the brassieres to provide features that accommodate receipt and support of the breast pump funnels. These seams, etc., can irritate the skin, making the brassieres uncomfortable to wear. While seamless brassieres are popular among women generally, designing seamless brassieres that can also accommodate pumping for nursing women has presented a challenge.

BRIEF SUMMARY

A garment for nursing and for use with a breast pump comprises at least one seamless cup comprising a plurality of at least partially overlapping material components. The plurality of at least partially overlapping material components comprises a first material component, a second material component, and a third material component. The first material component extends from an upper periphery of the at least one seamless cup toward a lower periphery of the at least one seamless cup. The second material component extends from the lower periphery of the at least one seamless cup toward the upper periphery of the at least one seamless cup. The third material component is connected to a shoulder strap of the garment, and the third material component extends from the shoulder strap to at least proximate the lower periphery of the at least one seamless cup. The third material component also extends from at least proximate a lateral side of the at least one cup toward a medial centerline of the garment.

Also disclosed is a garment for nursing and for use with a breast pump, which garment comprises a pair of brassiere cups. At least one brassiere cup of the pair comprises a first material component, a second material component, and a third material component. The first material component extends from an affixed edge along an upper periphery of the at least one brassiere cup to a free edge adjacent a lower periphery of the at least one brassiere cup. The second material component extends from an affixed edge along the lower periphery of the at least one brassiere cup to a free edge adjacent the upper periphery of the at least one brassiere cup. The third material component extends from an affixed edge adjacent the third periphery of the at least one brassiere cup to a shoulder strap of the garment. The third material component defines a free edge crossing the free edge of the second material component to define a nook.

Further disclosed is a garment for nursing and for use with a breast pump, which garment comprises a pair of shoulder straps, a rib band, and a pair of brassiere cups. Each brassiere cup of the pair of brassiere cups extends from the rib band along a lower periphery of the brassiere cup to one of the pair of shoulder straps at an upper periphery of the brassiere cup. Each brassiere cup comprises a seamless material component non-releasably affixed to the one of the pair of shoulder straps. The seamless material component extends from one of the pair of shoulder straps to at least proximate the lower periphery of the brassiere cup and defines a free edge extending perpendicularly relative to the rib band. Each brassiere cup also comprises at least one other seamless material component selectively connected to the one of the pair of shoulder straps. The at least one other seamless material component overlaps the seamless material component and extends from one of the upper periphery of the brassiere cup and the lower periphery of the brassiere cup toward a free edge of the at least one other seamless material component defined adjacent another of the upper periphery of the brassiere cup and the lower periphery of the brassiere cup.

DETAILED DESCRIPTION

Figure 1:
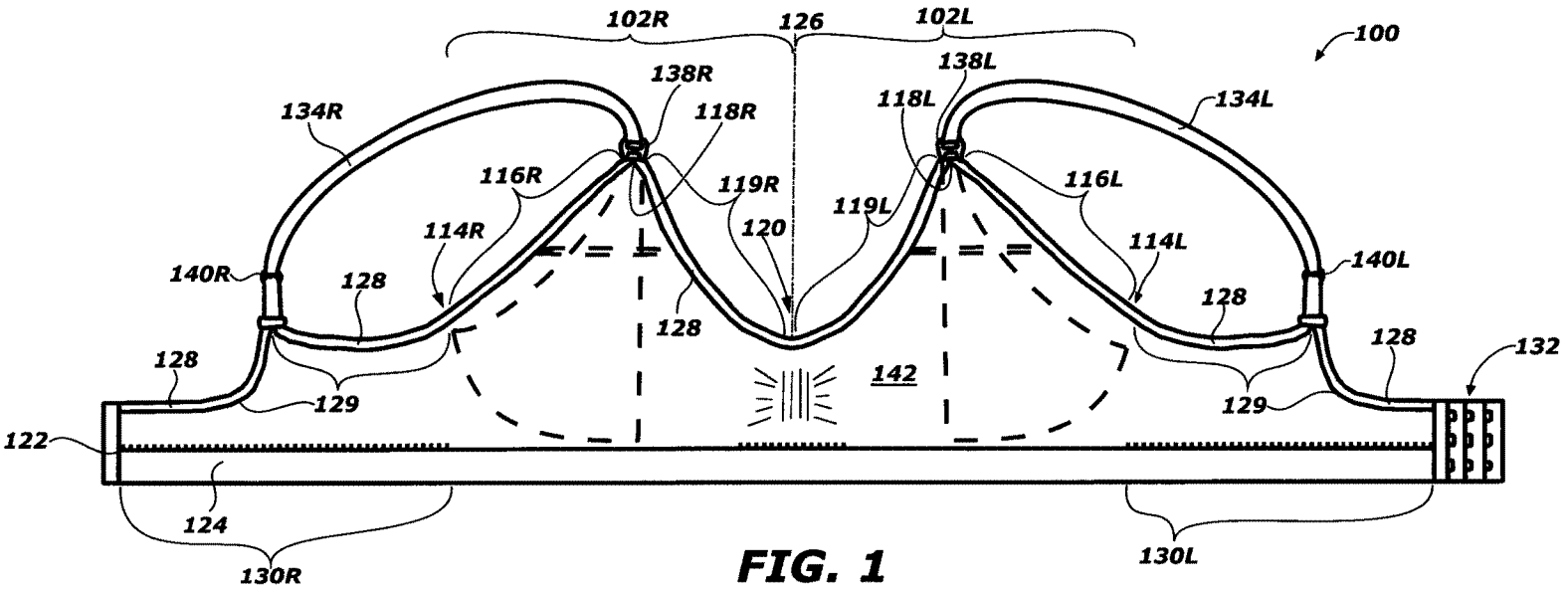
FIG. 1 is a front elevational view of a garment for nursing or pumping, in the configuration of a brassiere, having brassiere cups according to an embodiment of the present disclosure.

The illustrations presented herein are not meant to be actual views of any particular garment or component thereof, but are merely idealized representations that are employed to describe embodiments of the present disclosure.

As used herein, the terms "right" and "left," when referring to the garment, or part thereof, or to a wearer, or part thereof, mean the right and left, respectively, from the perspective of the wearer, the garment, or referenced part thereof.

As used herein, the term "lateral" means proximate to a side of a body, the garment, or referenced part thereof.

As used herein, the term "laterally," when referring to one feature's disposition relative to another feature's disposition, means the feature being disposed further from a medial centerline of the garment, and nearer to a lateral side of the garment, compared to the other feature's disposition relative to the medial centerline and the lateral side.

As used herein, the term "medial" means proximate to the midline of a body or the median axis of the garment or referenced part thereof.

As used herein, the term "medially," when referring to one feature's disposition relative to another feature's disposition, means the feature being disposed nearer to the medial centerline of the garment, and further from a lateral side of the garment, compared to the other feature's disposition relative to the medial centerline and the lateral side.

As used herein, the term "vertical" means a direction substantially parallel to the midline of a body or the median axis of the garment.

As used herein, the term "horizontal" means a direction substantially perpendicular to the midline of a body or substantially perpendicular to the median axis of the garment.

As used herein, the term "upper periphery" of a garment or of a brassiere cup means and refers at least a portion of the upper-most edge of the garment or the brassiere cup, not including shoulder straps.

As used herein, the term "lower periphery" of a garment or of a brassiere cup means and refers to at least a portion of the lower-most edge of the garment or the brassiere cup, not including torso portion extensions, if any.

As used herein, the term "straight," when referring to an edge of a component, means an edge that deviates less than 0.25 inch (less than 0.635 cm) from a line between the terminal points of the edge when the component is not being stretched.

As used herein, the term "disengaged configuration" means and includes a configuration in which components of the garment are positioned in a manner that does not enable engagement of the garment with a breast pump funnel, without moving one or more of the components from the configuration.

As used herein, the term "pumping configuration" means and includes a configuration in which components of the garment are positioned in a manner that enables engagement of the garment with a breast pump funnel.

As used herein, the term "nursing configuration" means and includes a configuration in which components of the garment are positioned in a manner that enables engagement between a breast and a nursing infant.

As used herein, "material" means and includes, for example and without limitation, fabric, cloth, textiles, and the like.

As used herein, the term "free edge," when referring to an edge of an identified component or layer, means an edge, of the identified component or layer, that is not affixed along its length to another layer of the garment such that the free edge is configured to be selectively and temporarily moved away from its disengaged configuration without permanently transforming the garment. For example and without limitation, a free edge may include an edge lacking, between its terminal points, any means to secure its length to the other layer. A free edge may also include an edge configured to be selectively unsecured along its length to the other layer, e.g., by a zipper, a hook-and-loop engagement, or the like.

As used herein, the term "attached edge," when referring to an edge of an identified component or layer, means an edge, of the identified component or layer, that is affixed along its length, in whole or in part, to one or more other layers of the garment such that the attached edge cannot be selectively moved from its disengaged configuration without permanently transforming the garment. For example and without limitation, an attached edge may include an edge stitched in whole or in part to secure its length to the one or more other layers. An attached edge may also include an edge glued or otherwise bonded to secure its length to the one or more other layer.

As used herein, the terms "unitary," "singular," and "continuous," when referring to a component or layer, mean and include a component or layer substantially lacking gaps, holes, or other openings defined interior to a periphery of the component or layer and lacking seams that join originally-separate portions or that substantially extend interior to the periphery of the component or layer.

As used herein, the term "seamless," when referring to a brassiere or other garment means and includes a brassiere or other garment having no seams, stitching, tacking, etc., internal to the periphery of a cup of the brassiere or other garment. Thus, while the cup's periphery may include seams or other stitching, the area of the cup that is within that periphery is free of seams, stitching, tacking, etc., in a "seamless" brassiere or other garment.

Moreover, as used herein, the term "seamless," when referring to a component of a brassiere or other garment, means and includes a component having no seams, stitching, tacking, etc., internal to a periphery of the component. Thus, while a component's periphery may include seams or other stitching, the area of the component that is within the periphery is free of seams, stitching, tacking, etc., in a "seamless" component.

The following description provides specific details, such as material types and attachment points in order to provide a thorough description of embodiments of the present disclosure. However, a person of ordinary skill in the art will understand that the embodiments of the present disclosure may be practiced without employing these specific details. Indeed, the embodiments of the present disclosure may be practiced in conjunction with conventional garment assembly techniques employed in the industry.

Garments for use by nursing women are disclosed. The garments include material components that at least partially overlap one another. The funnel of a breast pump may be received behind free edges of overlapping components such that the free edges support the funnel from multiple directions. Thus, a funnel may be received in the garment and supported for hands-free pumping. At least one of the material components is connected to a shoulder strap of the garment, while other material components are selectively connected to the shoulder strap. Thus, some of the material components may be released from and lowered away from the shoulder strap, exposing the breast for direct nursing, while at least one other material component continues to provide support. The same material component configured to provide support during nursing is also configured to provide support to the funnel of the breast pump during pumping. That material component may be formed so as to provide no irritating edge against the skin. Therefore, the garments provide comfort in addition to the functions of enabling nursing or pumping, at the wearer's election.

In the figures, components of the garment may include left-side components and right-side components. The left-side components are designated by an accompanying "(L)" (e.g., XL, where X represents a number) following the relative reference number, and the right-side components are designated by an accompanying "R" (e.g., XR, where X represents a number) following the relative reference number. Reference, in the description below, to a component without use of an accompanying L or R (e.g., X) is a reference to the component in a manner generic to both the left-side and the right-side components. Reference to a component with the use of the accompanying L or R (e.g., XL or XR) is a reference to the specifically-indicated left-side (e.g., XL) or right-side component (e.g., XR), respectively. Therefore, for example, a description of a "cup 102" is a description that applies to each of a "left-side cup 102L" and a "right-side cup 102R," and the "cup 102" is indicated in the figures as "102L," with respect to the left side and "102R," with respect to the right side of the garment.

Also, in the drawings, views of a left-side component may be described as being a mirror view of the corresponding right-side component, and vice versa. Therefore, descriptions of such a left-side component are descriptions of the mirror view of the right-side component.

Figure 2:
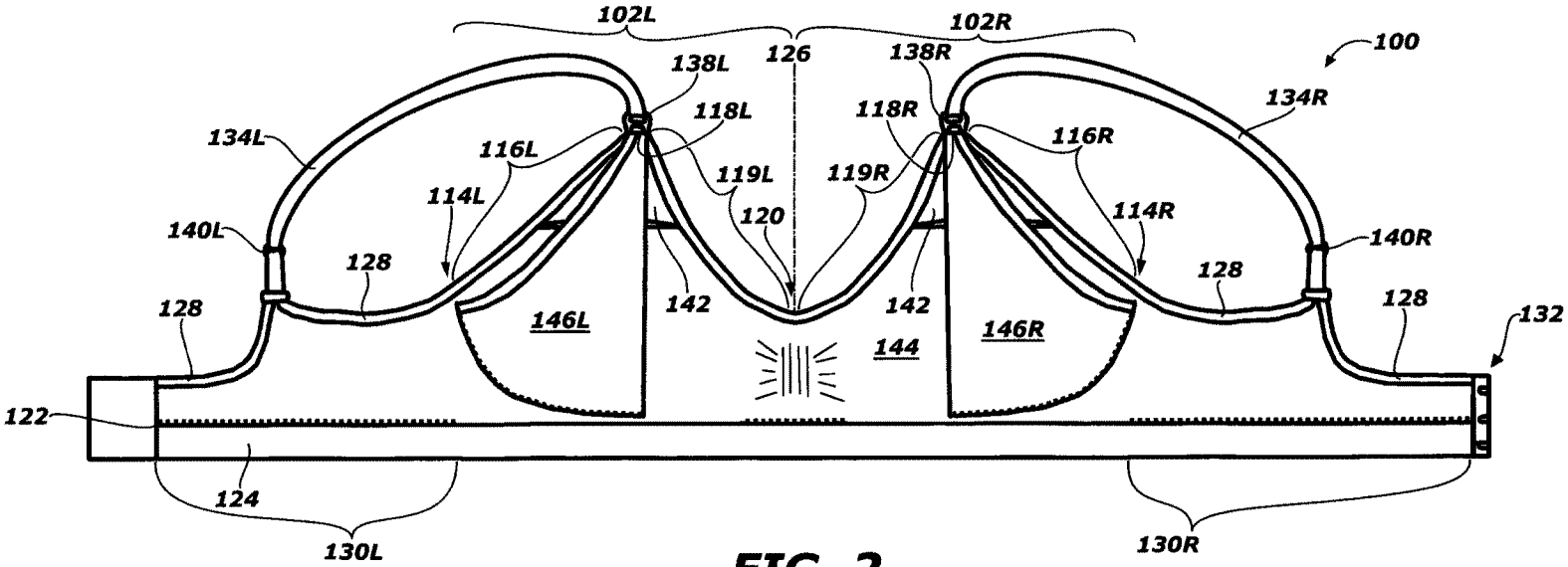
FIG. 2 is a rear elevational view of the garment of FIG. 1.

FIG. 1 illustrates a front view of a garment, in the configuration of a brassiere 100, according to at least a first embodiment of the present disclosure. FIG. 2 illustrates a rear view of the brassiere 100 of FIG. 1. The brassiere 100 may comprise brassiere cups, which may otherwise be referred to herein simply as "cups," (e.g., a left-side cup 102L and a right-side cup 102R) each comprising at least partially overlapping material components as described further with reference to FIGS. 3 through 14. As illustrated in FIG. 1, each of the cups 102 may comprise a lateral side 114 (which may also be referred to herein as the lateral side 114 of the brassiere 100), a lateral upper edge 116 extending from the lateral side 114 to a clasp attachment edge 118, a medial upper edge 119 extending from the clasp attachment edge 118 to a medial side 120 along a medial centerline 126 of the garment, and the medial side 120 extending from the medial upper edge 119 to a lower edge 122 (which may also be referred to herein as the lower edge 122 of the brassiere 100).

The lateral side 114 may be proximate to an arm of a wearer. The lower edge 122 may extend essentially under a breast of the wearer, extending from at least one of the lateral sides 114 to the medial side 120 of the respective one of the cups 102. In some embodiments, the lower edge 122 may continue from the medial side 120 along the other of the cups 102. The lower edge 122 may define an upper edge of a rib band 124 that can extend around the wearer's torso.

The lateral side 114, the lateral upper edge 116, the clasp attachment edge 118, the medial upper edge 119, the medial side 120, and the lower edge 122 of the cup 102 define the periphery of the cup 102. The lateral side 114 defines a lateral periphery of the cup 102. The lateral upper edge 116, the clasp attachment edge 118, and the medial upper edge 119 define an upper periphery of the cup 102. The medial side 120 defines a medial periphery of the cup. The lower edge 122 defines a lower periphery of the cup 102.

Edging 128 may be provided along the lateral upper edge 116, the medial upper edge 119, and, optionally, the clasp attachment edge 118 to add to the aesthetics of the brassiere 100 and the comfort of the wearer. The lateral sides 114 of the cups 102 may be attached, either seamlessly (as illustrated in FIG. 1) or via a seam or other attachment, to adjustable back band portions 130 extending at least partially around the wearer's torso. The edging 128 may be provided and extend along a length of an upper peripheral edge 129 of the adjustable back band portions 130 to add to the aesthetics of the brassiere 100 and the comfort of the wearer. In some embodiments, the adjustable back band portions 130 may comprise a closure mechanism, such as hook-and-eye back closures 132, a zipper, lacing, or the like, to secure the brassiere 100 around the wearer. In other embodiments, the adjustable back band portions 130 may lack hook-and-eye back closures 132, or other closure mechanism, and may comprise an elastic material configured to secure the brassiere 100 around the wearer.

The cups 102 may be attached, or attachable, to shoulder straps 134 (e.g., the left-side cup 102L may be attached, or attachable, to a left-side shoulder strap 134L, and the right-side cup 102R may be attached, or attachable, to a right-side shoulder strap 134R). The shoulder straps 134 may comprise clasps 138 and shoulder strap length adjusters 140. The shoulder strap length adjusters 140 may be configured to allow for length adjustments of the shoulder straps 134.

In these or other embodiments, the shoulder straps 134 may alternatively be adjustable to form other configurations of straps, such as criss-cross straps, one-shoulder strap, etc. In still other embodiments, the shoulder straps 134 may be formed as a halter top support, as a razor back support, or the like. Thus, other conventional strap or support configurations, joinable to the cups 102 via the clasps 138, may be implemented without departing from the present disclosure.

The clasps 138 may be configured to selectively attach components of the cups 102 to the shoulder straps 134 at the clasp attachment edges 118. As discussed below, while some components of the cups 102 may be selectively detachable via the clasps 138, another component of the cups 102 may be non-detachably connected to the clasps 138. Therefore, in some embodiments, the brassiere 100 may be configured such that components of each of the cups 102 may be selectively disconnected from its respective one of the shoulder straps 134 to enable the respective breast of the wearer to be exposed for direct nursing, while another component of each of the cups 102 remains in supportive connection with the shoulder straps 134. This enables a wearer to directly nurse an infant, or to directly apply the funnel of a pump to the uncovered breast, in a "nursing configuration," while the breast remains supported by the component that is non-detachably connected to the clasps 138.

Figure 3:
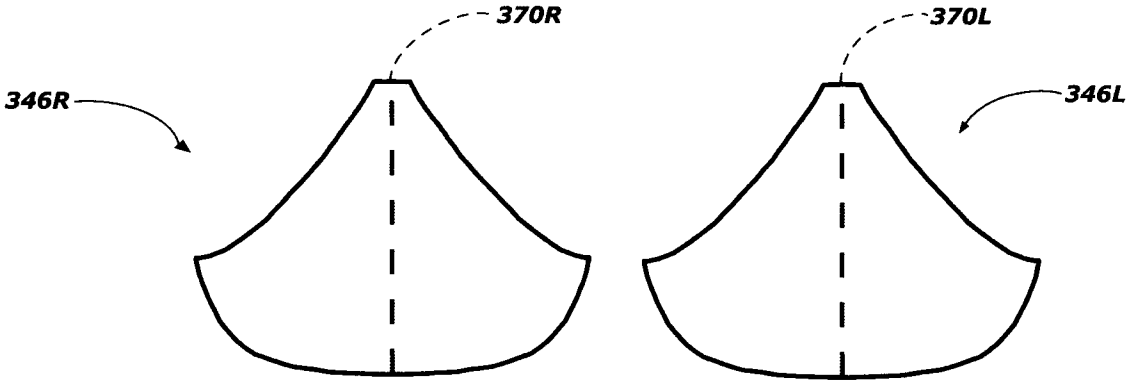
FIG. 3 is a front elevational view of material pieces for inner material components of the garment of FIGS. 1 and 2.
Figure 4:
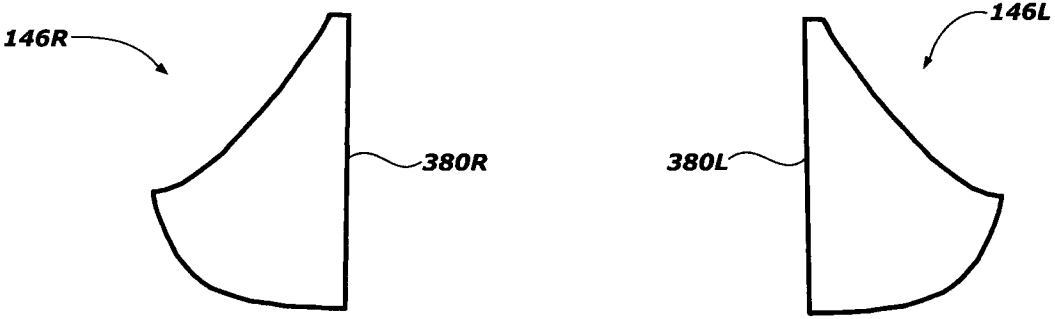
FIG. 4 is a front elevational view, and also a rear elevational view, of inner material components of the garment of FIGS. 1 and 2.

Each cup 102 of the brassiere 100 may comprise a plurality of at least partially overlapping material components. The cup 102 may comprise a first material component 142, such as an outer (i.e., outermost) material component (FIG. 7); a second material component 144, such as a middle material component (FIGS. 5 and 6); and a third material component 146, such as an inner (i.e., innermost) material component (FIGS. 3 and 4). The cups 102, when assembled to form the brassiere 100, may have an appearance substantially similar to the appearance of cups of a conventional brassiere. The brassiere 100 may be configured such that each of the first material component 142 and the second material component 144 cover and conceal the nipple and the majority of the breast when the components 142 and 144 are in a disengaged configuration and not being stretched. Accordingly, the brassiere 100 may be worn in the same manner as a conventional brassiere, e.g., for long periods of time, as an undergarment, or may be configured as outerwear.

In at least one embodiment, each of the third (e.g., inner) material components 146 may be formed from a folded-over material piece. With reference to FIG. 3, a material piece 346 may be cut from a panel of fabric, such as a stretchable fabric, and then folded in half, along line 370. Thus, with reference to FIG. 4, each third material component 146 includes two layers of material joined by a folded edge 380, rather than by a seam or stitching. Therefore, when the third material component 146 is worn against the skin, with the folded edge 380 adjacent the center of the breast, the folded edge 380 provides a soft, non-irritating edge that is comfortable to the wearer.

In other embodiments, each third material component 146 may be formed of a single material piece that is not folded, such that the edges of the material piece define the edges of the component.

Figure 5:
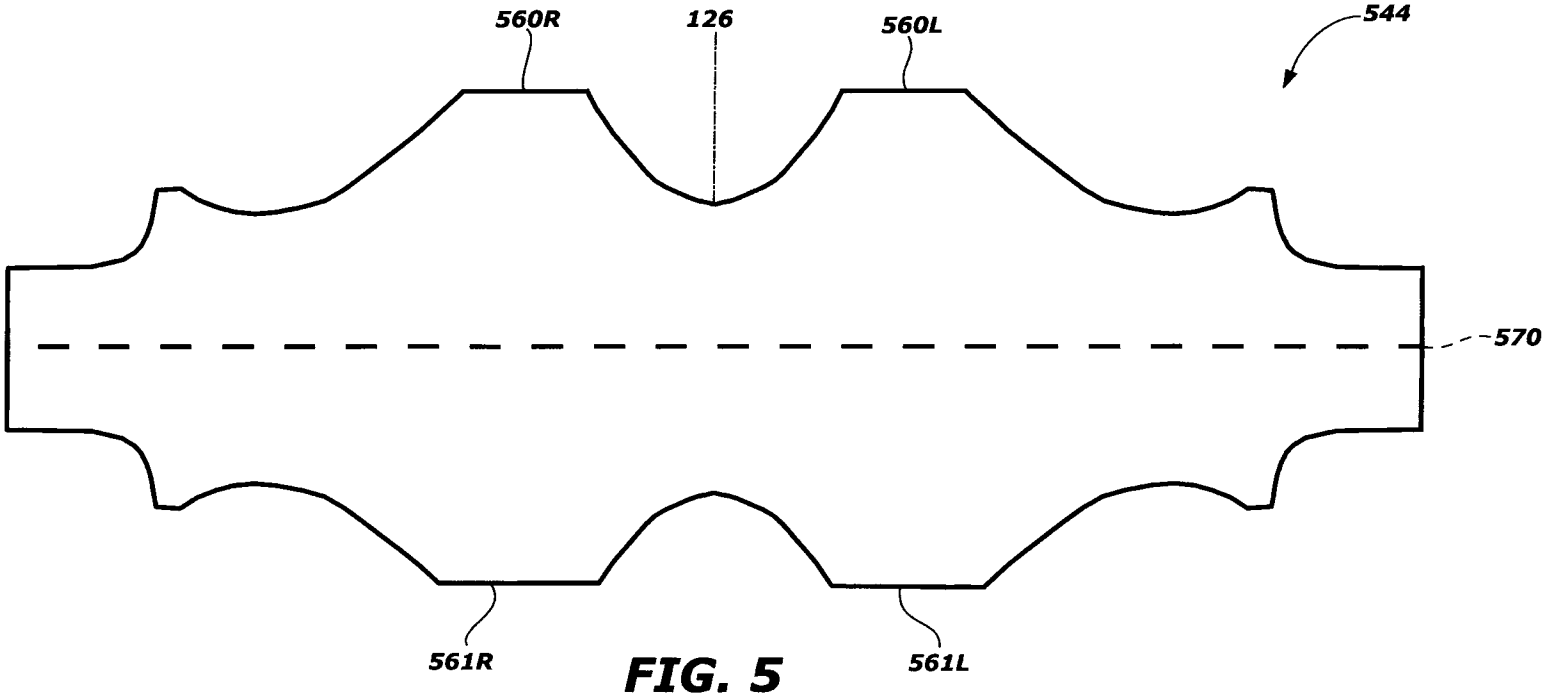
FIG. 5 is a front elevational view, and also a rear elevational; view, of a material piece for a middle material component of the garment of FIGS. 1 and 2.
Figure 6:
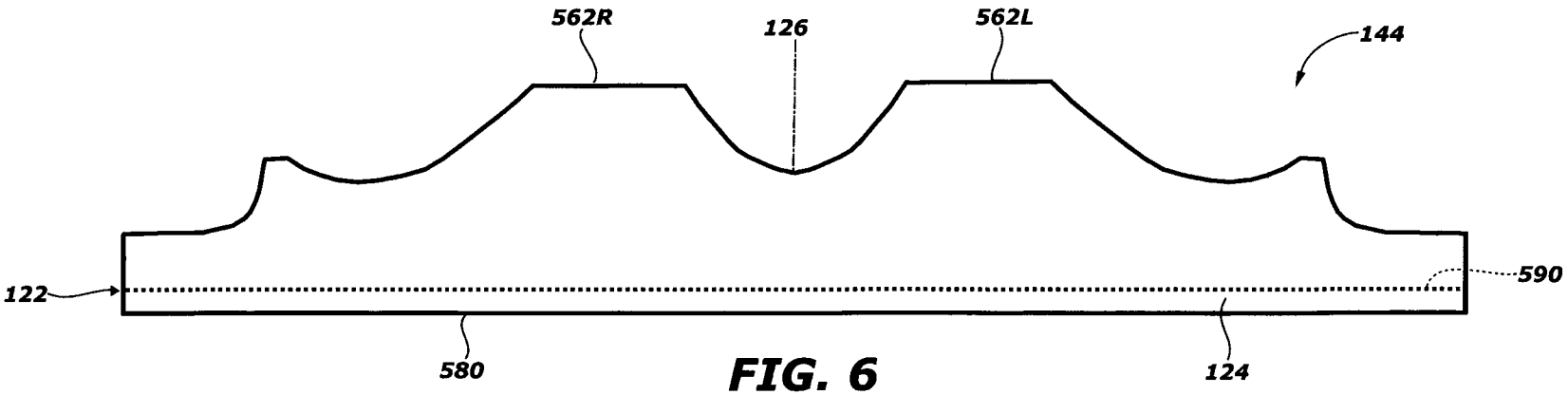
FIG. 6 is a front elevational view, and also a rear elevational view, of the middle material component of the garment of FIGS. 1 and 2.
Figure 7:
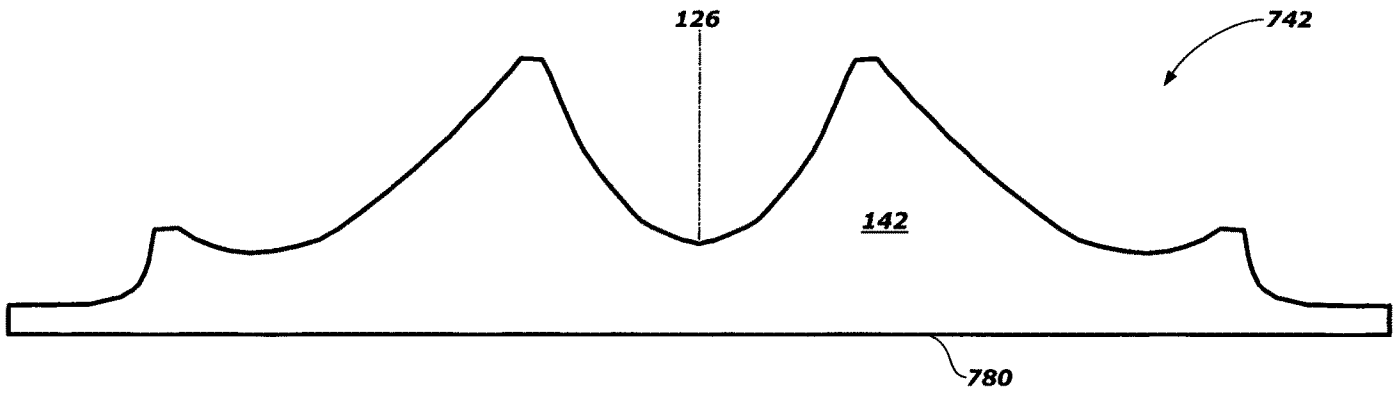
FIG. 7 is a front elevational view, and also a rear elevational view, of a material piece for an outer material component of the garment of FIGS. 1 and 2.

In at least one embodiment, the second (e.g., middle) material components 144 may be formed from another folded-over material piece. With reference to FIG. 5, a material piece 544 may be cut from another panel of fabric, such as a stretchable fabric, and then folded in half, along line 570. Cutting of the material piece 544 may define peripheral edges, including edges 560 and 561, which edges 560, 561 align when the material piece 544 is folded over. The fabric from which the material piece 544 is cut may be the same or different from the fabric used for the material piece 346 (FIG. 3) for the third material components 146. Thus, with reference to FIG. 6, the second material component 144 includes two layers of material joined along a folded edge 580, with edges 560, 561 (FIG. 5) providing edge 562 of the second material component 144.

A seam 590 may be added adjacent the folded edge 580. The area between the seam 590 and the folded edge 580 may form the rib band 124 of the brassiere 100 (FIG. 1). Thus, the seam 590 may be made along and define the lower edge 122 of the cups 102 (FIG. 1). Accordingly, with one material piece (i.e., material piece 544) and one straight seam 590 both the second material component 144 and the rib band 124 are formed. In some embodiments, the material of the rib band 124 may be textured (e.g., with ruching, or the like) to increase the elastic pull of the rib band 124 portion of the material.

A portion of the material piece 544 proximate the medial centerline 126 of the garment (and of the material piece 544) may also be treated (e.g., with ruching, or the like) to increase the elastic pull of the material in that portion. Thus, the material of the second material component 144 may be gathered near the medial centerline 126 to improve the aesthetics of the brassiere 100 and to further shape the second material component 144.

In other embodiments, the second material component 144 may be formed of a single material piece that is not folded, such that the edges of the material piece define the edges of the second material component 144. It may be attached to a separately cut rib band, or the lower portion of the single-piece second material component 144 may form the rib band.

The first (e.g., outer) material component 142 may be formed from an additional material piece 742, which may be cut from a panel of fabric, such as a stretchable fabric. Cutting the material piece 742 may define the peripheral edges of the first (e.g., outer) material component 142, including a lower peripheral edge 780.

In other embodiments, the first (e.g., outer) material component may be formed by cutting a material piece that is folded over itself to provide the lower peripheral edge as a folded edge.

A portion of the material piece 742 proximate the medial centerline 126 of the garment (and of the material piece 742) may be treated (e.g., with ruching, or the like) to increase the elastic pull of the material in that portion. Thus, the material of the first material component 142 may be gathered near the medial centerline 126 to improve the aesthetics of the brassiere 100 and to further shape the first material component 142.

Figure 8:
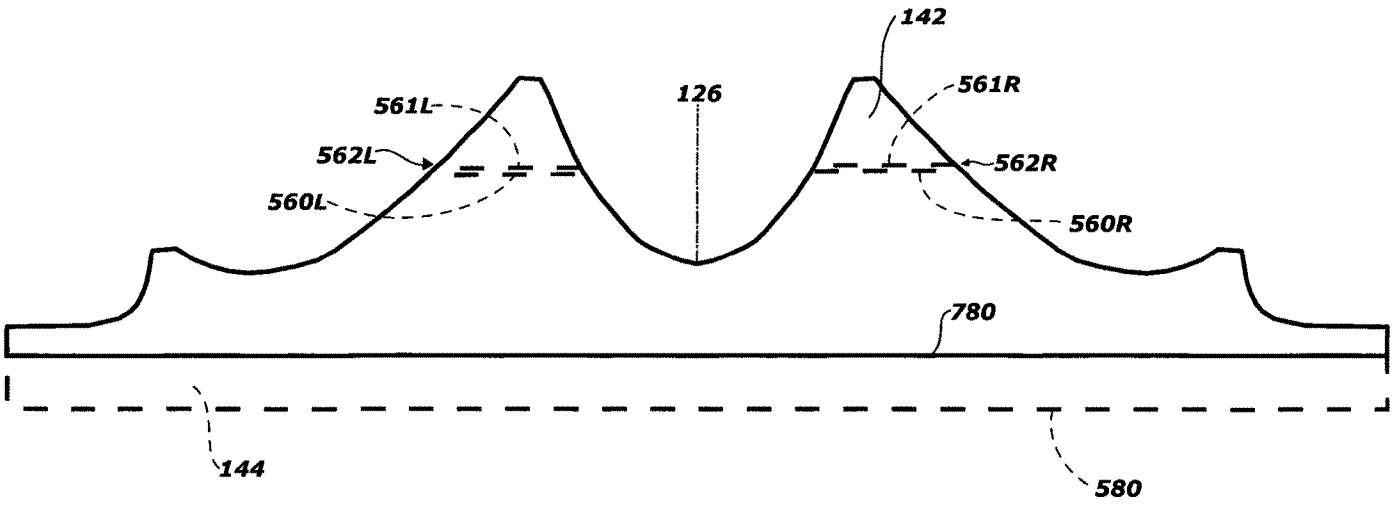
FIG. 8 is a rear elevational view of the middle material component, shown in dashed line, overlapping the outer material component of the garment of FIGS. 1 and 2.
Figure 9:
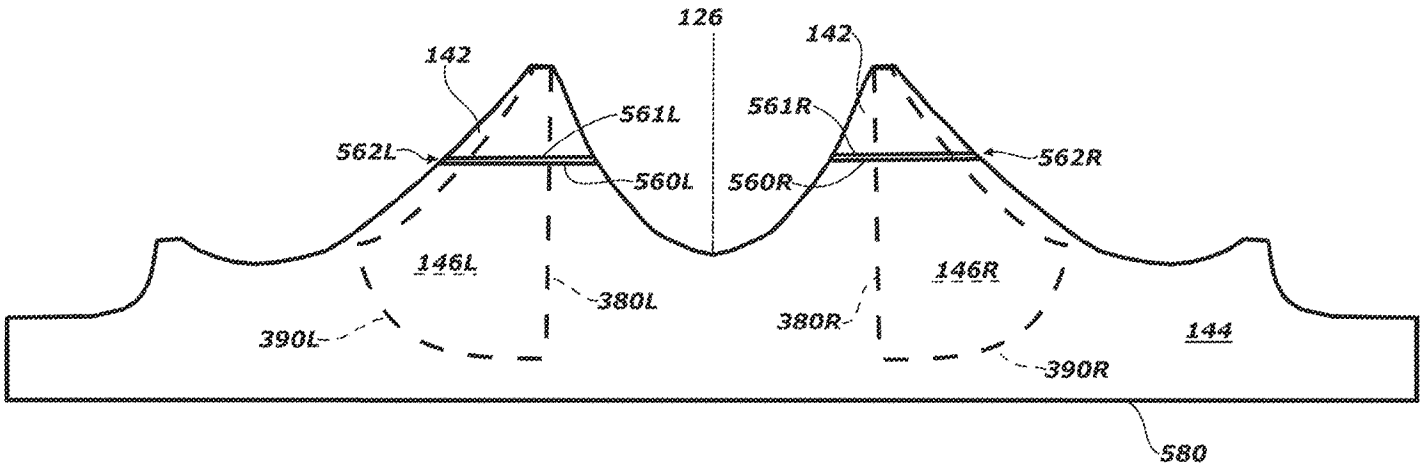
FIG. 9 is a rear elevational view of the inner material components, shown in dashed lines, overlapping the middle material component and overlapping the outer material component of the garment of FIGS. 1 and 2.
Figure 10:
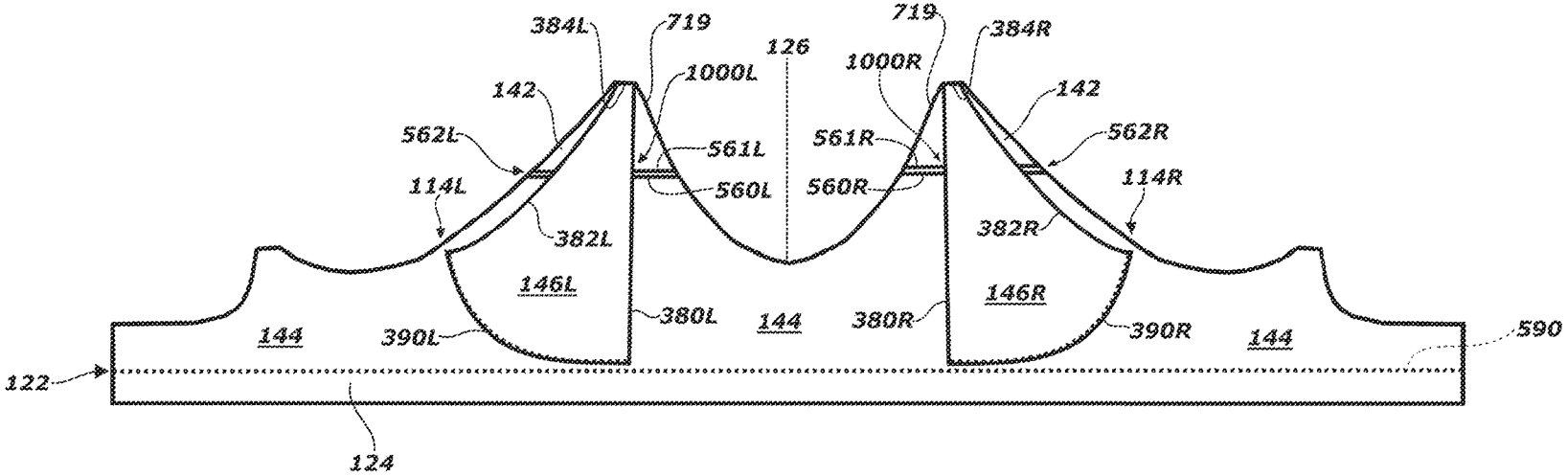
FIG. 10 is a rear elevational view of the inner, middle, and outer material components of the garment of FIGS. 1 and 2.

With reference to FIGS. 8 to 10, illustrated, from a rear perspective, are stages in a method of constructing the brassiere 100 of FIGS. 1 and 2. With reference to FIG. 8, the second (e.g., middle) material component 144 may be overlaid on the first (e.g., outer) material component 142 such that the second material component 144 extends below the lower peripheral edge 780 of the first material component 142 and such the first material component 142 extends above edge 562 (provided by aligned edges 560, 561) of the second material component 144. With reference to FIG. 9, the third (e.g., inner) material component 146, shown in dashed lines, of each cup 102 (FIG. 1) may be overlaid on the second material component 144 such that an upper portion of the third material component 146 extends above the edge 562 (provided by aligned edges 560, 561) of the second material component 144. With reference to FIG. 10, in which the third material component 146 is shown in solid line, the third material component 146 is arranged such that a lower peripheral edge 390 extends from the lateral side 114 of the cup 102 (FIGS. 1 and 2) to proximate the lower edge 122 of the brassiere 100 (FIGS. 1 and 2), i.e., proximate the seam 590. The lower peripheral edge 390 may curve along its length. In other embodiments, the lower peripheral edge may be straight or may include two straight portions joining at an angle.

With continued reference to FIG. 10, the third material component 146 may be joined to the second material component 144, such as by a seam along the lower peripheral edge 390 to join the lower periphery of the third material component 146 to at least the inner-most material layer of the second material component 144. Thus, the lower peripheral edge 390 of the third material component 146 is an attached edge. The folded edge 380 and a lateral upper edge 382 of the third material component 146 may remain free edges, not affixed to either the second material component 144 or the first material component 142 along the length of each. A clasp attachment edge 384 of the third material component 146 may be non-detachably joined to one of the shoulder straps 134R, 134L (FIGS. 1 and 2) via one of the clasps 138R, 138L (FIGS. 1 and 2).

The third material component 146 may be arranged such that its folded edge 380 (also referred to herein as a "free edge" 380 of the third material component 146), crosses over the upper edge 562 (and edges 560, 561) of the second material component 144. The upper edge 562 (and edges 560, 561) may also be free edges (and therefore also referred to herein as "free edges" 560, 561, 562 of the second material component 144). The remainder of the upper periphery of the second material component 144 may be joined to the aligning portions of the upper periphery of the first material component 142, e.g., by the edging 128 (FIGS. 1 and 2).

Where the free edge 380 of the third material component 146 crosses the free edges 560, 561, 562 of the second material component 144, a nook 1000 is defined. As discussed in more detail below, a funnel of a breast pump is receivable within the nook 1000. For example, as illustrated in FIG. 10, the nook 1000 may be defined with its mouth directed upwardly and medially, as along an upper portion of the medial upper edge 119 of the cup 102 (FIG. 1).

Because the free edge 380 of the third material component 146 may be substantially perpendicular to the lower edge 122 of the cup 102, while the free edges 560, 561, 562 of the second material component 144 may be substantially parallel to the lower edge 122 of the cup 102, the nook 1000 may be substantially V-shaped, e.g., L-shaped. As used herein, the term "V-shaped" means and includes a shape defined by two sides meeting at a point and defining an angle of less than 180°. It includes a right-angled V-shape, which is also referred to herein as an "L-shape," in which the two sides meet at a point and define an angle of 90° or about 90°. It also includes an acute-angled V-shape, in which the two sides meet at an angle of less than 90°.

The first material component 142 may at least partially overlap the nook 1000 (e.g., may fully overlap the nook 1000), such that the nook 1000 is not exteriorly-visible from a front view of the cup 102 (FIG. 1) in the disengaged configuration illustrated in FIGS. 1 and 2. The covering of the nook 1000 by the first material component 142, in the disengaged configuration illustrated in FIGS. 1 and 2, may define a substantially triangular shape formed by, for example, the free edge 380 of the third material component 146, the free edges 560, 561, 562 of the second material component, and a medial upper edge 719 of the first material component 142.

Figure 11:
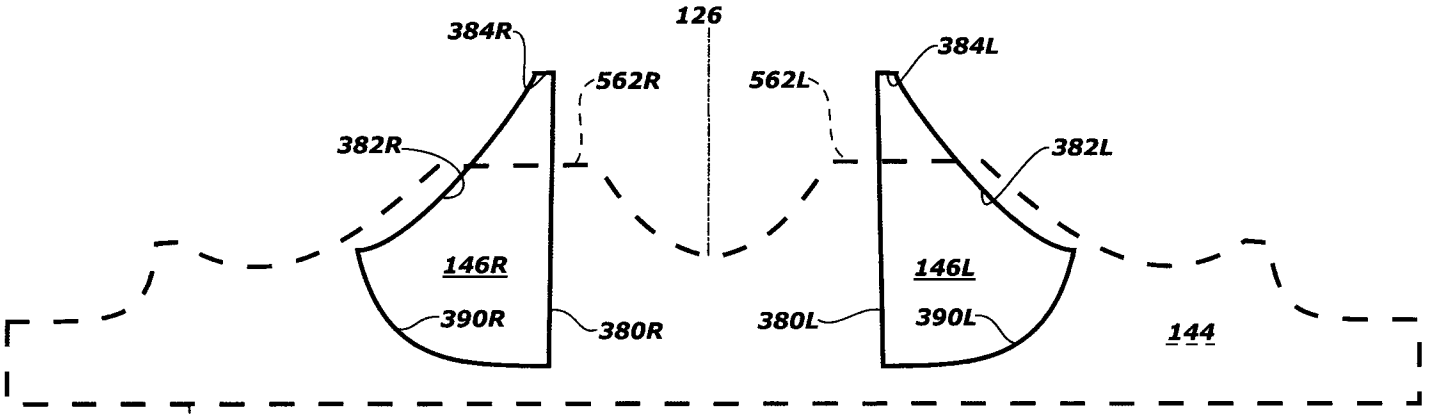
FIG. 11 is a front elevational view of the middle material component, shown in dashed lines, overlapping the inner material components of the garment of FIGS. 1 and 2.
Figure 12:
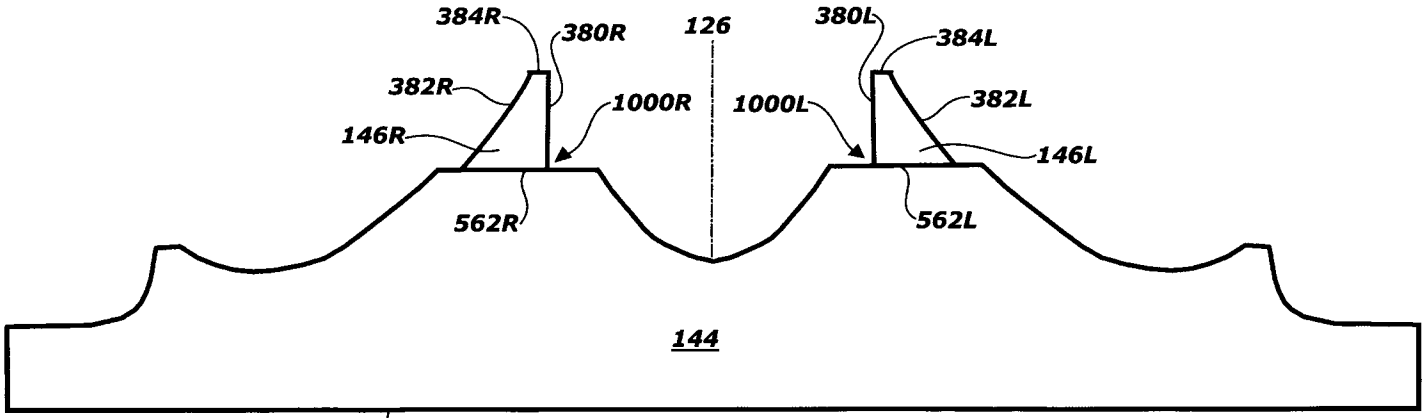
FIG. 12 is a front elevational view of the middle material component overlapping the inner material components of the garment of FIGS. 1 and 2.

With reference to FIGS. 11 to 14, illustrated, from a front perspective, are stages in the method of constructing the brassiere 100 of FIGS. 1 and 2. With reference to FIGS. 11 and 12, the second (e.g., middle) material component 144, shown in dashed lines, may be overlaid on the third (e.g., inner) material component 146 such that the third material component 146 extends above the free edge 562 (as provided by free edges 560, 561 (FIGS. 5 and 6) of the second material component 144, with the free edge 380 of the third material component 146 crossing the free edge 562 of the second material component 144 to define the nook 1000. The lower peripheral edge of the second material component 144, i.e., the folded edge 580, is below the lower peripheral edge 390 of the third material component 146.

Figure 13:
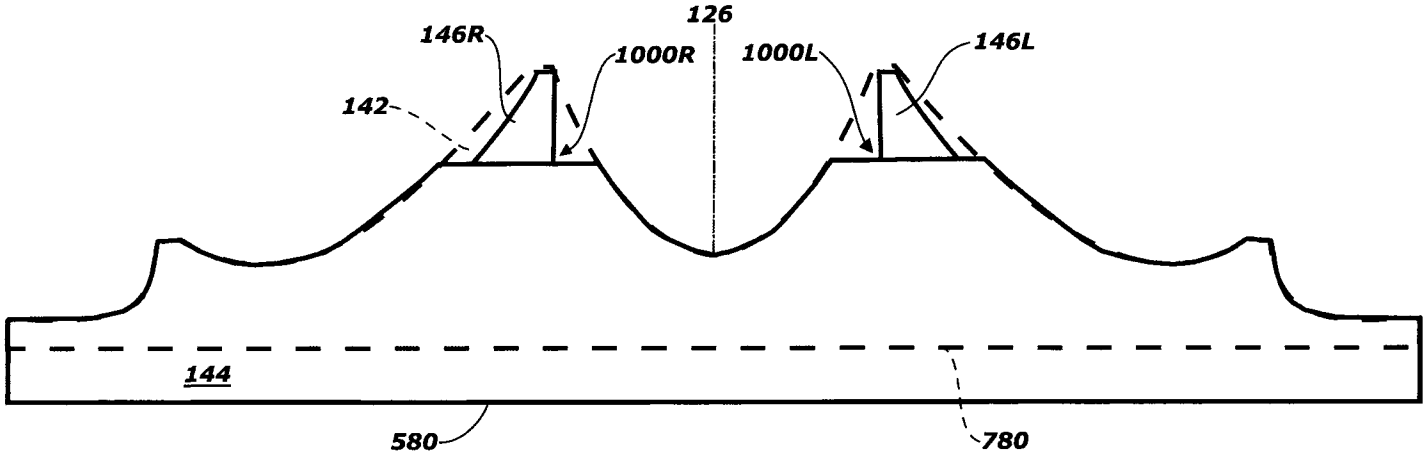
FIG. 13 is a front elevational view of the outer material component, shown in dashed lines, overlapping the middle material component and overlapping the inner material components of the garment of FIGS. 1 and 2.
Figure 14:
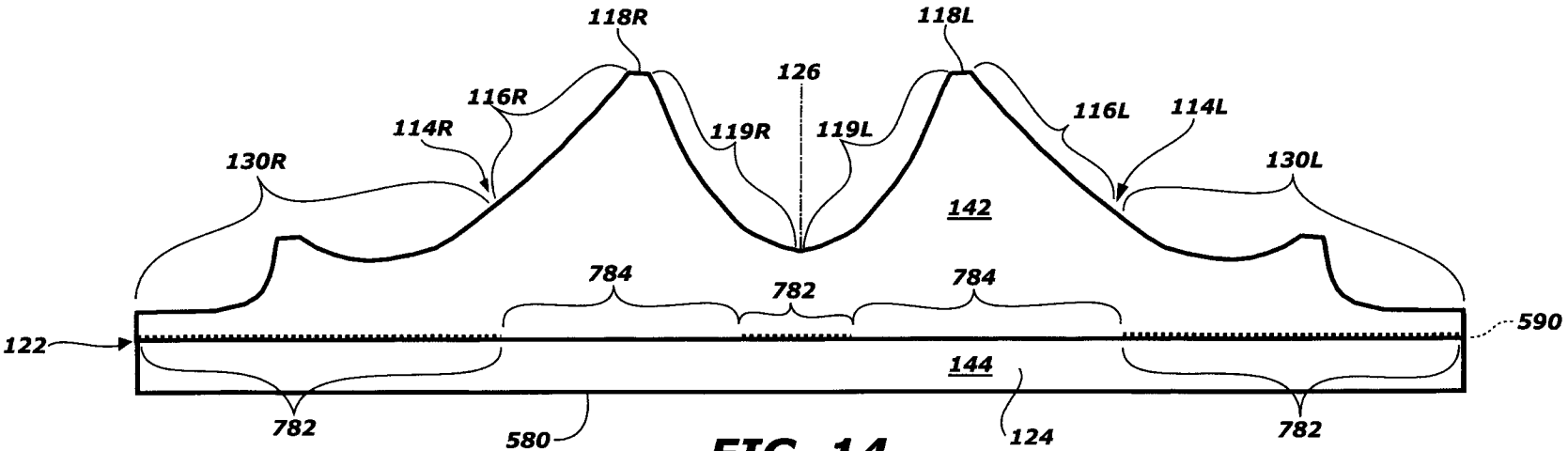
FIG. 14 is a front elevational view of the outer material component overlapping the middle material component and overlapping the inner material components of the garment of FIGS. 1 and 2.

With reference to FIGS. 13 and 14, the first (e.g., outer) material component 142 may be overlaid on the second material component 144 such that the folded edge 580 of the second material component 144 extends below the lower peripheral edge 780 of the first material component 142. The lower peripheral edge 780 of the first material component 142 may align at or proximate the seam 590 in the layers of the second material component 144. Thus, the lower peripheral edge 780 of the first material component 142 may align along the top of the rib band 124. Portions of the lower peripheral edge 780 of the first material component 142 may be attached (e.g., by stitching (represented by dense dashed lines)) to one or both of the layers of the second material component 144. The portions provide affixed edge portions 782 along the lower edge 122, leaving free edge portions 784 along other portions of the lower edge 122. The free edge portions 784 may extend along the center of the lower periphery of the cups 102 (FIGS. 1 and 2). Thus, the affixed edge portions 782 may be along the back band portions 130 and proximate the medial centerline 126. The free edge portions 784 define free edges of the first material component 142. The upper periphery of the first material component 142 may be joined, e.g., by edging 128 (FIGS. 1 and 2) to the majority of the upper periphery of the second material component 144, i.e., along all but the free edge 562 (FIG. 12) of the second material component 144.

Figure 15:
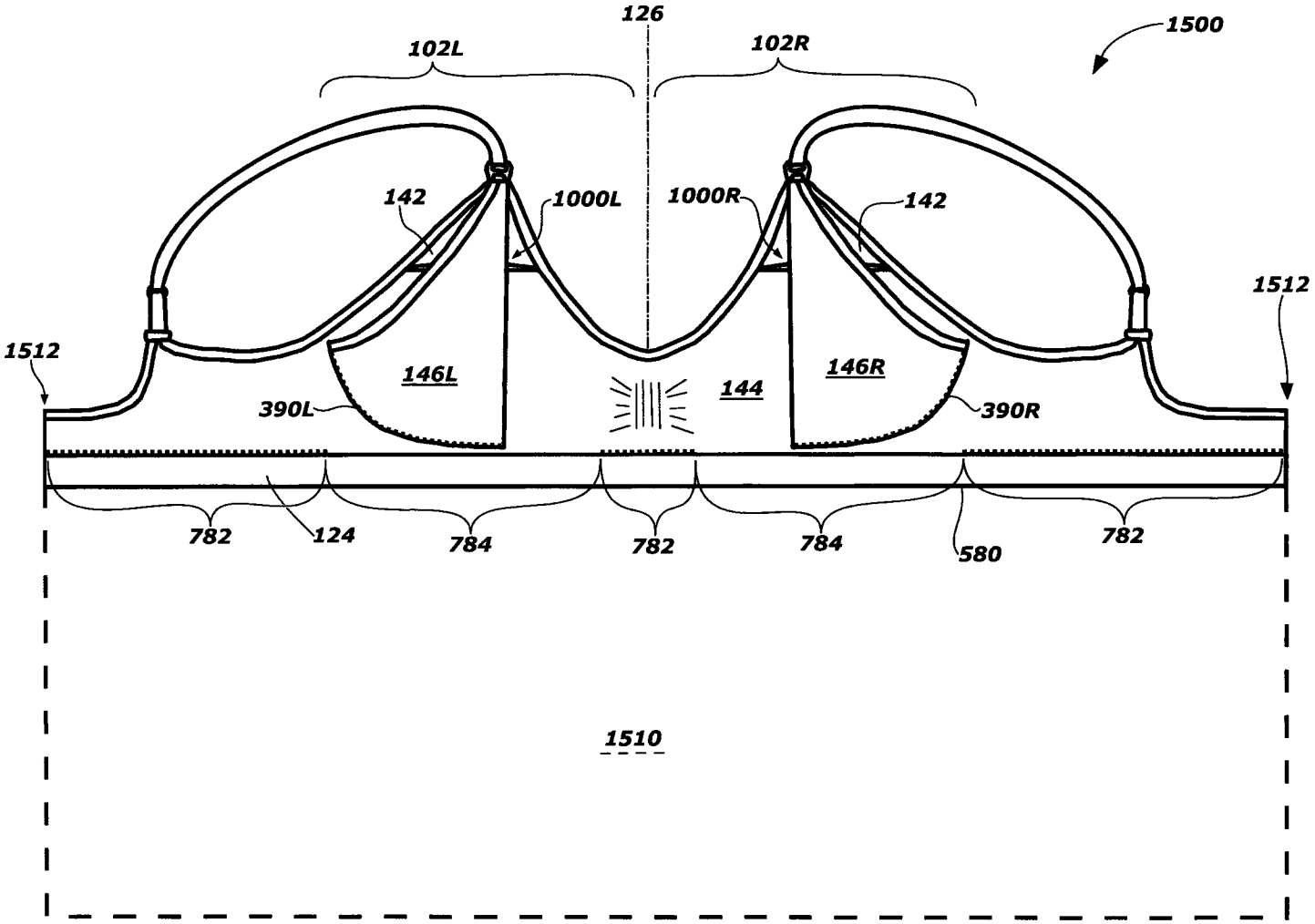
FIG. 15 is a rear elevational view of a pumping garment, in the configuration of a tank having a brassiere portion, shown in solid line, and a torso portion, shown in dashed lines, the brassiere portion having the brassiere cups of the garment of FIGS. 1 and 2.

In at least a second embodiment of the present disclosure, the cups 102 of the FIGS. 1 through 14 may be incorporated into a garment configured as tank top 1500 illustrated in FIG. 15. The tank top 1500 includes a brassiere portion including the cups 102 of FIGS. 1 through 14, with a torso portion 1510 connected along the folded edge 580 (or other lower peripheral edge) of the second material component 144. The torso portion 1510 may be joined along a back center portion 1512. For example, the torso portion may be a seamless tube. In other embodiments, the torso portion 1510 may be joined along side seams (not shown). Thus, the brassiere 100 and cups 102 of FIGS. 1 through 14 may be incorporated into alternate garment types, while still providing a garment for both nursing and pumping.

Figure 16:
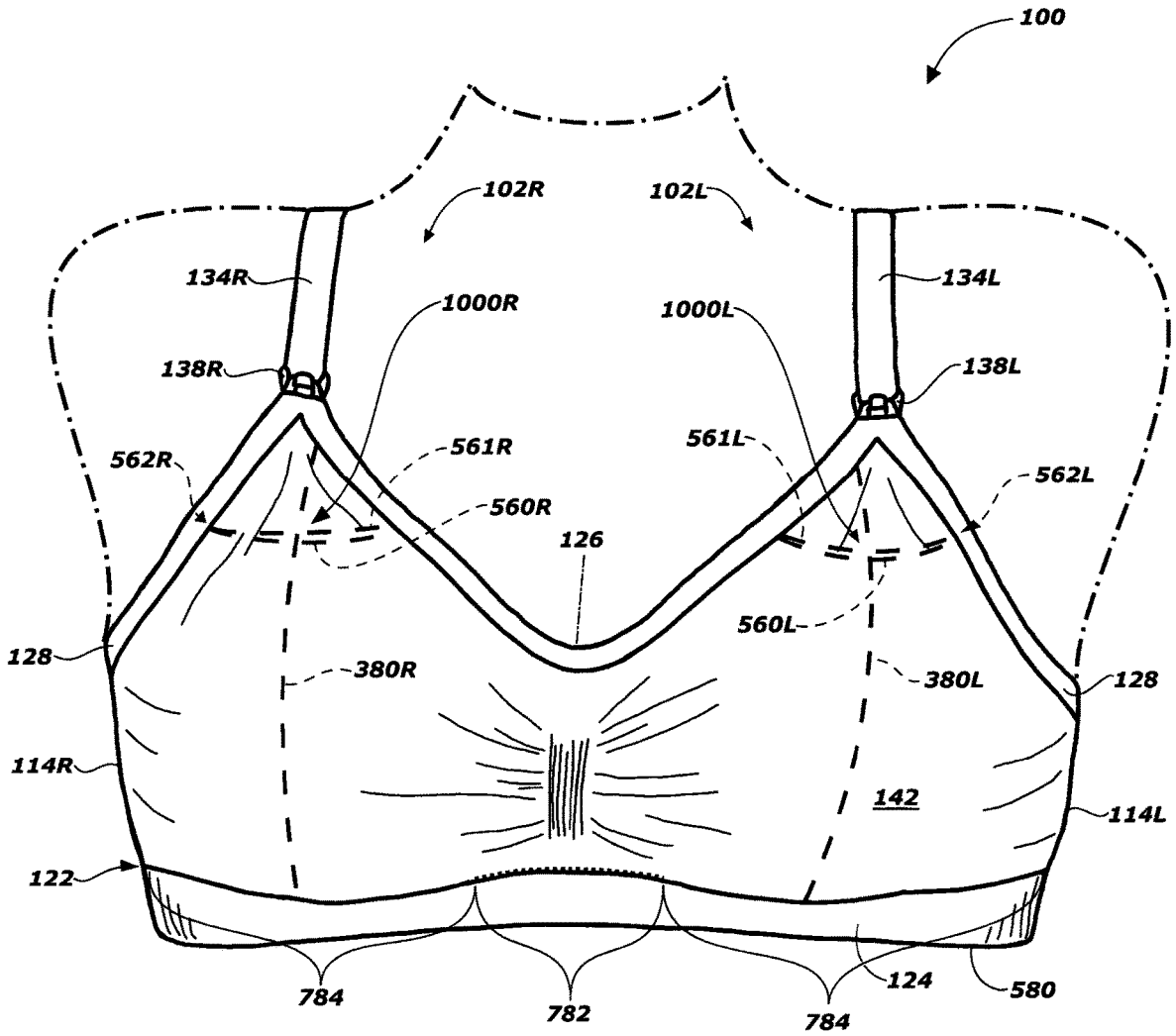
FIG. 16 is a front elevational view of the garment of FIGS. 1 and 2, as worn.

With reference to FIG. 16, illustrated is the brassiere 100 of FIGS. 1 and 2 as worn and in a disengaged configuration. In such configuration, the first material component 142 covers the nooks 1000R, 1000L and substantially all, or completely all, of the other components of the cups 102. In some embodiments, no portion of the third material component 146 (FIG. 2) is visible when the brassiere 100 is worn in the disengaged configuration. In some such embodiments, no portion of the second material component 144 (FIG. 2) may be visible when the brassiere 100 is worn in the disengaged configuration; however, the rib band 124, formed from the folded edge 580 and seamed section of the material piece 544 forming the second material component 144, may be visible. The affixed edge portion 782 proximate the medial centerline 126 interrupts the free edge portions 784 along a majority of the lower periphery of the cups 102.

Figure 17:
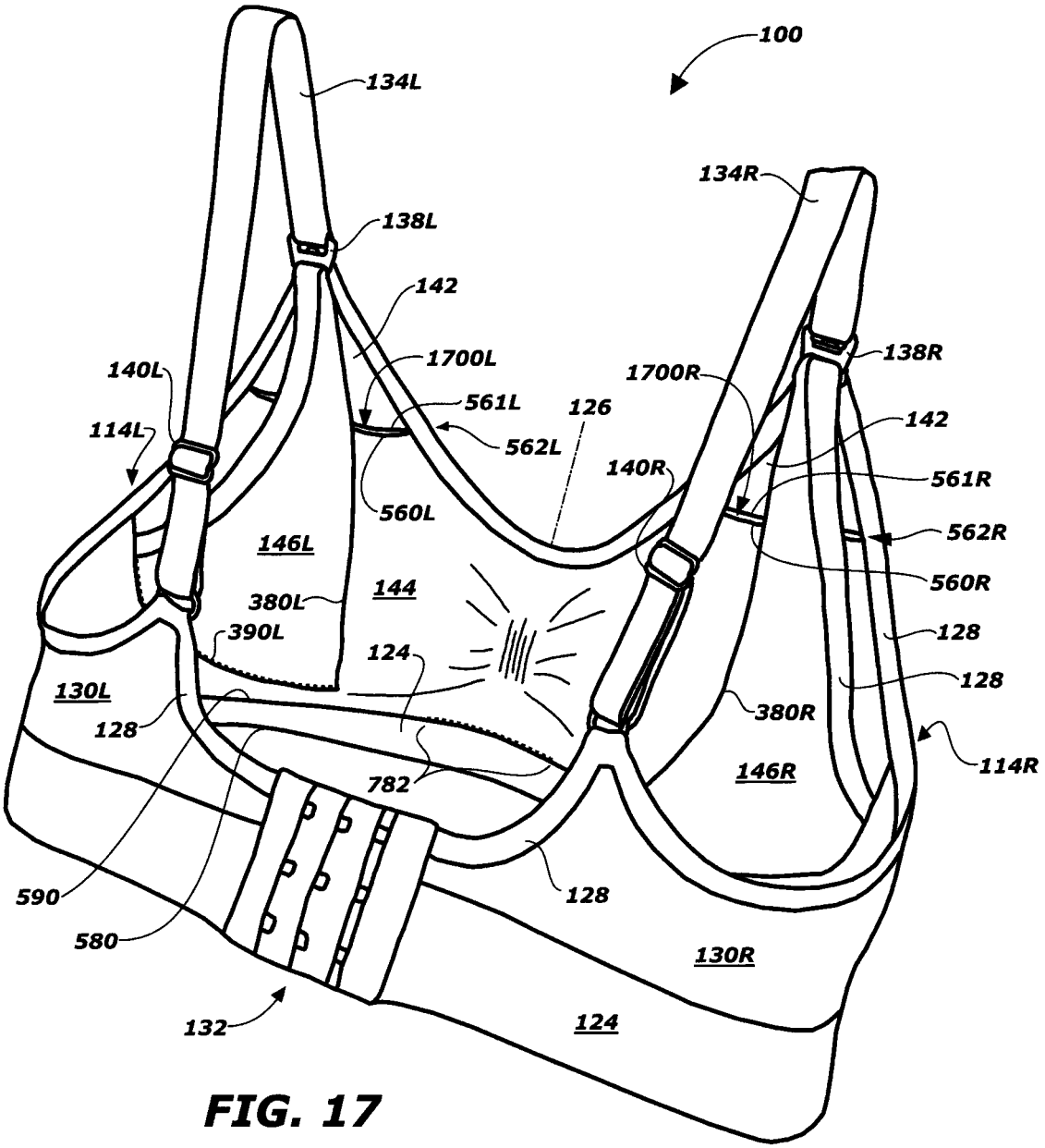
FIG. 17 is a rear and right-side perspective view of the garment of FIGS. 1 and 2, with the rib band fastened.
Figure 18:
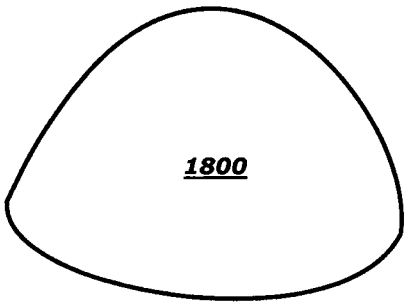
FIG. 18 is a rear elevational view of a removable nursing pad usable with the garment of FIGS. 1, 2, and 15.
Figure 19:
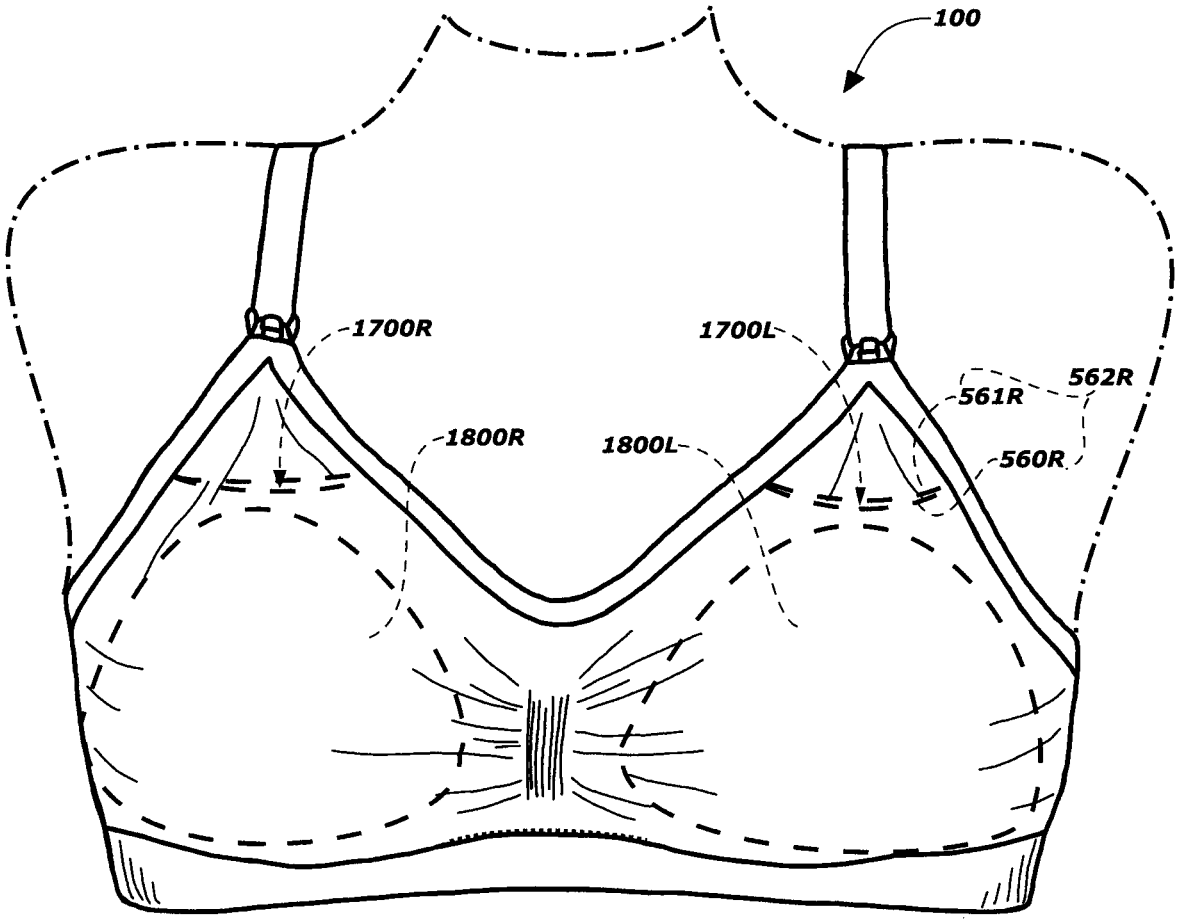
FIG. 19 is a front elevational view of the garment of FIGS. 1 and 2, with a pair of the removal nursing pads of FIG. 18 received between layers of the middle material component of the brassiere cups.

With reference to FIGS. 17 and 18, the second (e.g., middle) material component 144 may be configured to selectively receive a nursing pad 1800 between the material layers of the second material component 144. That is, a pocket 1700 may be defined between the material layers formed when folding over the material piece 544 of FIG. 5. The mouth of the pocket 1700 may be defined by the edges 560, 561 that provide the edge 562 of the second material component 144. The lower periphery of the pocket 1700 is defined by either the folded edge 580 or the seam 590 that defines the rib band 124. The nursing pad 1800 may be selectively inserted into, and received by, the pocket 1700 of the second material component 144 and selectively removed therefrom when the wearer no longer desires the nursing pad 1800 to be included or to replace the nursing pad 1800 with another. FIG. 19 illustrates the nursing pads 1800L, 1800R in place once received within the pockets 1700L, 1700R of the second material component 144 (FIG. 17).

Figure 20:
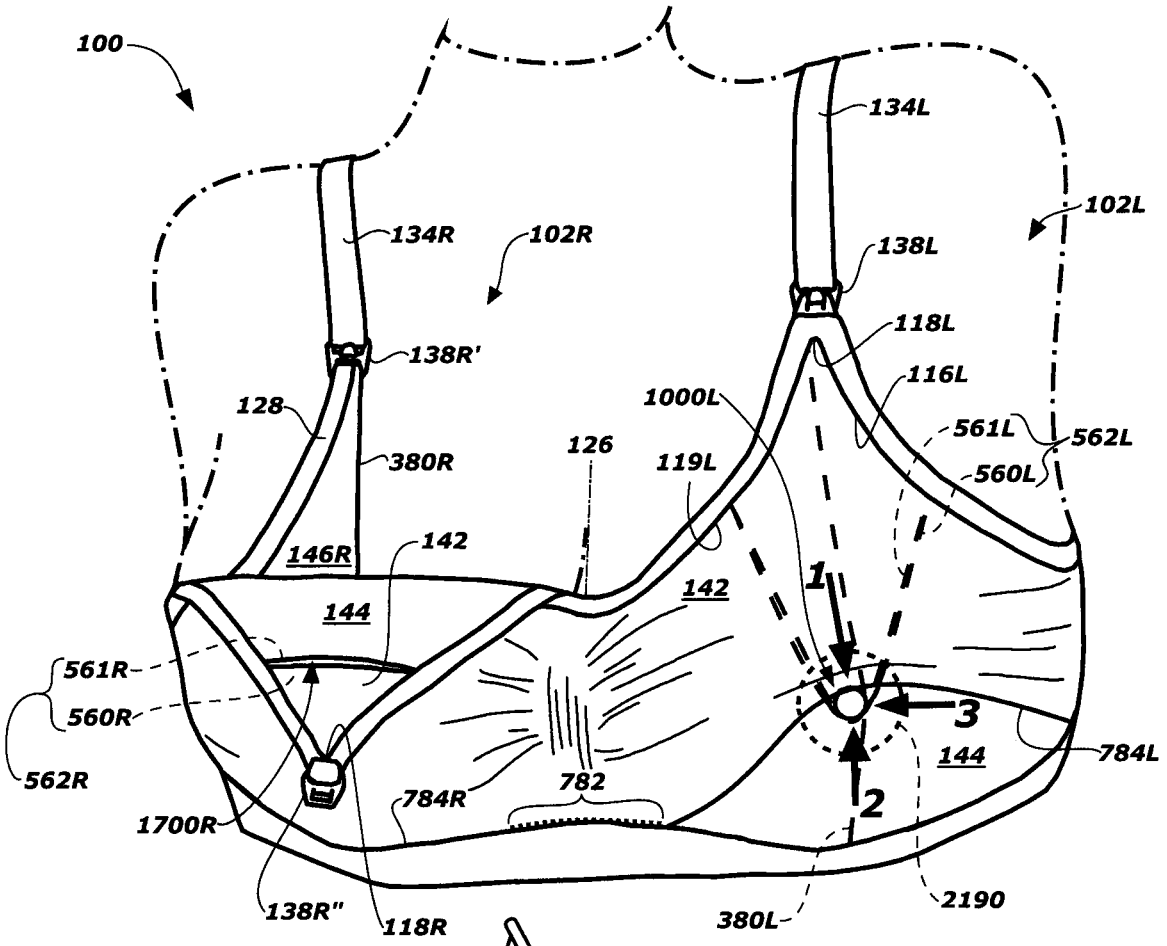
FIG. 20 is a front elevational view of the garment of FIGS. 1 and 2, with a right brassiere cup in a nursing configuration and with a left brassiere cup in a pumping configuration.
Figure 21:
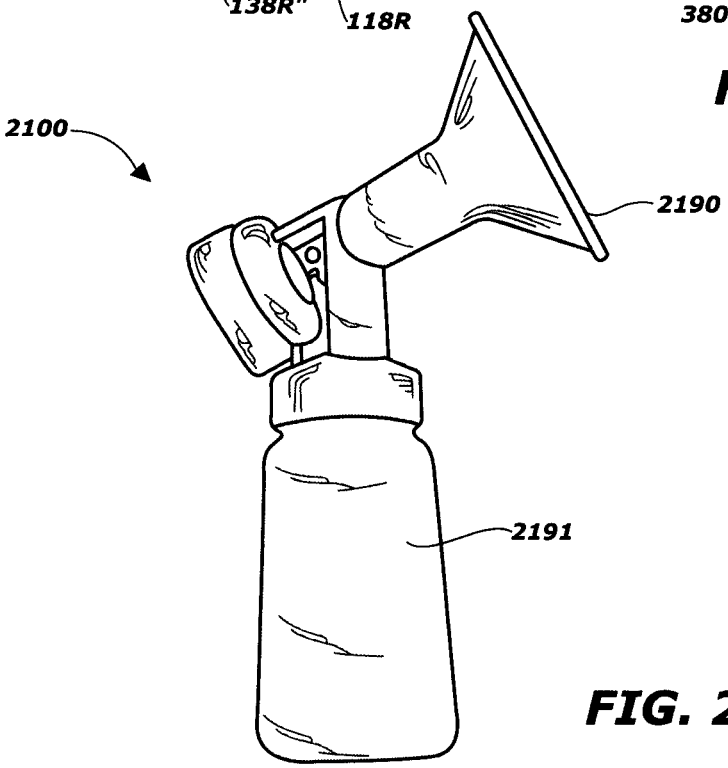
FIG. 21 is a side elevational view of a funnel and a reservoir of a conventional breast pump usable with the garments of FIGS. 1, 2, and 15.

With reference to FIGS. 20 and 21, the brassiere 100 enables nursing and/or pumping. As illustrated, the right-side cup 102R has been transitioned from a disengaged configuration (see FIG. 16) to a nursing configuration. In the nursing configuration, the clasp 138 (FIG. 16) associated with the right-side cup 102R has been unclasped, such that at least two selectively joinable portions (e.g., a first joinable portion 138' and a second joinable portion 138") have been disengaged from one another. The first joinable portion 138' may be affixed to the shoulder strap 134, and joined, e.g., affixedly, to the third material component 146 along the clasp attachment edge 384 (FIG. 12). In other embodiments, the first joinable portion 138' may be releasably joined to the third material component 146. The second joinable portion 138" may be affixed to the first material component 142, along the clasp attachment edge 118. Due to the joining of the first material component 142 to the second material component 144 along the upper periphery of each (except for edges 560, 561, 562 of the second material component 144), the second material component 144 is indirectly affixed to the second joinable portion 138" of the clasp 138. Each clasp 138 may be configured to be selectively disengaged by disconnecting the first joinable portion 138' from the second joinable portion 138", to allow the first material component 142 and the second material component 144 to be moved away from at least one of the shoulder straps 134, uncovering the third material component 146 and at least a portion of the breast thereunder and allowing for direct nursing of an infant, or direct hand-supported application of a funnel 2190 (FIG. 21) for breast pumping. In this nursing configuration, the breast remains supported by the connection of the third material component 146 to the shoulder strap 134 via the first joinable portion 138' of the clasp 138. Also, in this nursing configuration, if used for a hand-supported application of the funnel 2190 for breast pumping, the free edge 380 of the third material component 146 and the folded down edge of the lowered other components 144, 142 may be used to provide some support to the funnel (e.g., from the lateral direction, via free edge 380, and from below, via the folded down edge of the other lowered components 144, 142). Thus, even in the nursing configuration can the brassiere 100 provide some support assistance for pumping.

Once nursing, or hand-supported pumping, is completed, the second joinable portion 138" may be re-engaged with the first joinable portion 138' to transition the cup 102 back to the disengaged configuration (FIG. 16). Thus, the brassiere 100 enables direct nursing of an infant without having to disrobe and without having to wholly detach any component from the brassiere 100.

With continued reference to FIGS. 20 and 21, the left-side cup 102L has been transitioned from the disengaged configuration (see FIG. 16) to a pumping configuration. In the pumping configuration, the clasp 138 remains engaged, such that the breast remains essentially fully covered by the material components 142, 144, 146 of the brassiere 100. Even so, the funnel 2190 may be inserted among the first, second, and third material components 142, 144, 146 with the funnel 2190 supported by free edges thereof, i.e., the free edge portion 784 at a lower periphery of the first material component 142, the free edge 562 (provided by free edges 560, 561) of the second material component 144, and the free (folded) edge 380 of the third material component 146. Thus, the "free edges" of the cup 102 include free edge portion 784, edge 562 (by edges 560, 561), and free edge 380.

Of the free edges of the cup 102, the free edge portion 784 of the first material component 142 extends a majority of the width of the cup 102, along the lower edge 122 thereof, and in parallel with the lower edge 122 and perpendicular to the medial centerline 126 of the brassiere 100. Thus, the first material component 142 extends from the upper periphery of the cup 102 toward, e.g., to, the lower edge 122 of the cup 102, where the first material component 142 defines the free edge portion 784. Accordingly, the first material component 142 may cover substantially all, or all, of the breast when in a disengaged configuration (FIG. 16).

The free edge 562 (provided by edges 560, 561) of the second material component 144 extends horizontally between the lateral upper edge 116 and the medial upper edge 119 of the brassiere 100. The free edge 562 may be disposed about 1.5 inches (about 3.81 cm) below (e.g., about 2.0 inches (about 5.08 cm) below, the clasp attachment edge 118. Thus, the second material component 144 extends from the lower edge 122 of the cup 102 toward the upper periphery of the cup 102, with the free edge 562 is proximate the clasp attachment edge 118 of the cup 102. The second material component 144 may cover substantially all of the breast when in a disengaged configuration (FIG. 16), and the free edge 562 may be parallel to the free edge portion 784 of the first material component 142.

The free edge 380 (provided by the folded edge 380) of the third material component 146 extends substantially vertically between the clasp attachment edge 118 of the cup 102, and thus the shoulder strap 134 and clasp 138, and an area of the cup 102 proximate to, or at, the lower periphery of the cup 102, e.g., proximate to, or at, the lower edge 122 of the cup 102. The third material component 146 extends from proximate the lower edge 122 to the shoulder strap 134 clasp 138 and extends from proximate the lateral side 114 of the cup 102 (FIG. 2) toward the medial centerline 126 of the brassiere 100. The third material component 146 may extend about halfway along the width of the breast, e.g., about one-third the width of the breast to about one-half the width of the breast. Thus, the third material component 146 does not add substantially to the thickness of the brassiere 100 along a central portion of the brassiere 100, but provides side support and shaping for the wearer. Moreover, because the edge of the third material component 146 that is worn most central to the breast is a soft edge formed by a fold of, e.g., soft, stretchable fabric, the third material component 146 provides a non-harsh edge that may be more comfortable than a conventional nursing support strap comprising a material such as conventionally also used for a shoulder strap.

In some embodiments, the free edges of the cup 102 may lack any means to secure the free edge along its length, interior to the periphery of the cup 102, to another material component of the brassiere 100. In other embodiments, the free edges may comprise means to selectively secure a portion of the length thereof to another material component of the brassiere 100 by securing means, such as by snaps, buttons, hook-and-loop engagements, or the like. The free edges may be selectively unattached from the securing means when the cup 102 is used in a pumping configuration.

With continued reference to FIG. 21, a breast pump 2100 usable with the brassiere 100 (FIG. 20) may be conventional, such that the funnel 2190 and reservoir 2191 may be configured as in conventional breast pumps. Therefore, the details thereof are not discussed in detail herein.

With returned reference to FIG. 20, and the left-side cup 102L thereof, shown in the pumping configuration, the funnel 2190 (shown in broken lines) is received within the cup 102L. The free edges (i.e., edges 380, 562 (provided by 560, 561), 784) are shown as dashed lines in FIG. 20 where the free edges are hidden from view by an overlapping material component. Each of the free edges (i.e., edges 380, 562 (provided by 560, 561), 784) of the material components 142, 144, 146, respectively, of the cup 102 is configured to support the funnel 2190 of the conventional breast pump 2100 (FIG. 21) from a respectively different direction and against a nipple of a breast and to prevent the funnel 2190 from moving out of place, even as the reservoir 2191 of the breast pump 2100 fills with expressed milk.

In some embodiments, the first material component 142, the second material component 144, and the third material component 146 may comprise a uniformly stretchable material such as spandex, LYCRA®, nylon, or the like, or blends thereof. Each of the first material component 142, second material component 144, and third material component 146 may be made from the same material or from different materials. The stretchable material causes an elastic-like pull, from multiple directions, against the funnel 2190 of the breast pump 2100 (FIG. 21) when the funnel 2190 is received in the nook 1000 and behind the free edges 380, 562 (provided by 560, 561), 784. In any regard, the free edge of each material component may be configured to be stretched away from its respective non-stretched shape to accommodate insertion of the funnel 2190 within the nook 1000.

With continued references to FIG. 20, the funnel 2190 may be supported in at least three directions. The free edge portion 784 of the first material component 142 may be stretched away from the lower edge 122 of the cup 102. The free edge portion 784 along the lower periphery of the first material component 142 may support the funnel 2190 substantially from above and provide a downward force on the funnel 2190 as indicated by directional arrow 1. The free edge 562 (provided by edges 560, 561) along a portion of the upper periphery of the second material component 144 may be stretched away from the upper periphery of the cup 102, and away from the clasp attachment edge 118 of the cup 102. The free edge 562 (provided by both edges 560, 561) of the second material component 144 may support the funnel 2190 substantially from below and provide an upward force on the funnel 2190 as indicated by directional arrow 2. The free (folded) edge 380 of the third material component 146 may be stretched away from the medial side 120 of the cup 102 and the medial centerline 126 of the brassiere 100 (FIG. 1). The free (folded) edge 380 of the third material component 146 may support the funnel 2190 substantially from the lateral side and provide a lateral force on the funnel 2190 toward the medial centerline 126, as indicated by directional arrow 3. Thus, the three-directional forces, provided by the free edges (i.e., edges 380, 562 (provided by 560, 561), 784) hold the funnel 2190 in tension when the funnel 2190 is positioned over the nipple, even as milk is expressed from the breast and the reservoir 2191 (FIG. 21) of the breast pump 2100 (FIG. 21) is filled and becomes heavier. Further, as each of the material components is somewhat stretched away from the chest to accommodate the breast and the funnel 2190, each material component urges the funnel 2190 to remain pressed against the nipple and breast. Accordingly, the funnel 2190 may be supported in a direction perpendicular to the surface of the cup 102. Still further, because the free edge 380 of the third material component 146 (i.e., the folded edge) spans from an upper periphery of the cup 102 to or proximate to a lower periphery of the cup 102, the funnel 2190 may be selectively positioned, in the nook 1000, at essentially any point along the height of the cup 102, subject to the opposite forced tension from the lower free edge portion 784 of the first material component 142 and the upper free edge 562 of the second material component 144. Moreover, the free edge 380 of the third material component 146 provides lateral support to the funnel 2190 even as the funnel 2190 may move longitudinally lower as the reservoir 2191 (FIG. 21) of the breast pump 2100 (FIG. 21) fills during pumping. In addition, the lateral support in the direction of arrow 3, toward the medial centerline 126 (and toward the sternum of the wearer) urges the funnel 2190 and the breast pump 2100 (FIG. 21) to remain central to the wearer's body and away from the wearer's arms. This enables the arms to remain free to engage in other activities (e.g., typing, phone handling, and the like) during hands-free pumping. The medially directed lateral support force, in the direction of arrow 3, also lessens the likelihood of the breast pump 2100 (FIG. 21) being accidentally contacted by the wearer's arm or by other objects, while the wearer is using the brassiere 100 for hands-free pumping.

In some embodiments, the opposing forces provided by the free edge portion 784 of the first material component 142 and the upper free edge 562 of the second material component 144 may provide sufficient support for the funnel 2190 during pumping, without additional support from the free edge 380 of the third material component 146.

It should be noted that while FIG. 20 illustrates the right-side cup 102R in the nursing configuration and the left-side cup 102L in the pumping configuration, either of the cups 102R, 102L may be transitioned between the disengaged configuration (FIG. 16) and either of the nursing and pumping configurations.

Thus, in the embodiments of the brassiere 100 of FIGS. 1 through 14, 16, 17, 19, and 20, and in the embodiment of the tank top 1500 of FIG. 15, the configuration and elasticity of the overlapping material components of the cups 102 may enable a wearer to support the funnel 2190 against her nipple, hands free, regardless of whether the nipple is located in the exact center of the breast or is offset somewhat. The elasticity of the material of the material components the brassiere 100 and tank top 1500 enable the funnel 2190 to be selectively shifted by the wearer proximate to a center of the cup 102. Regardless of where, in this region, the funnel 2190 is shifted by the wearer, the funnel 2190 will retain support from the multiple directions of force (arrows 1 through 3). Nonetheless, the nooks 1000 defined by the overlapping free edges (e.g., edges 380 and 562 (provided by 560, 561)) provide an adjustable opening, rather than a static, fixed-dimension, fixed location "hole" or slit that limits the relative positions of the funnel 2190 to the breast of the wearer. Still further, because the funnel 2190 is supported by each of the multiple material components in multiple directions, the wearer may not need to hassle with separate attachment mechanisms or attachment devices such as hooks, buttons, zippers, hook-and-loop connections, or the like. Also, because the multiple material components support the funnel 2190 from multiple (e.g., three directions), this may decrease the likelihood that the funnel 2190 will move away from the nipple undesirably during hands-free pumping. Additionally, the multiple material components are configured to provide increased coverage of the breast when the brassiere 100 or tank top 1500 is in a pumping configuration. The nooks 1000 may be configured to provide the minimal opening necessary to support the funnel 2190. Accordingly, the garments of at least one embodiment disclosed herein provides for a modest garment for both pumping and nursing.

Moreover, the configuration of the third material component 146 enables it to function both as a support during nursing (e.g., in the nursing configuration as right-side cup 102R of FIG. 20) and as a funnel support during pumping (e.g., in the direction of arrow 3 in the pumping configuration as left-side cup 102L of FIG. 20). The configuration of the medial-most edge of the third material component 146, i.e., the free edge 380 as a folded edge of material provides a soft edge against the skin, rather than a harsh, stitched, or hard edge of conventional nursing support straps.

While, in the figures, the free edge 380 of the third material component 146 is the only free edge 380 provided as a folded edge, in other embodiments, the second material component 144 may be configured such that the free edge thereof (i.e., edge 562) is a folded edge, without defining the pocket 1700 (FIG. 17), and the first material component 142 may be configured such that the free edge thereof (i.e., edge portion 784) is a folded edge.

Furthermore, each of the material components 142, 144, 146 may be seamless, i.e., lacking seams, stitching, or the like interior to the periphery of the respective material component 142, 144, 146. Accordingly, along the portions of the material covering the majority of the breast, including the nipple, the material components 142, 144, 146 may consist of material, and free of potentially-irritating seams, stitching, etc. Therefore, the garments 100, 1500 may be configured as "seamless" garments for nursing and for use with the breast pump 2100 (FIG. 21).

While the exemplary embodiments illustrate garments incorporating two cups each configured for hands-free pumping or nursing, at the wearer's election, the invention is not limited to use in pairs, but may be used in a garment having one conventional cup, e.g., one cup not configured to receive the funnel of a breast pump. Further, while in the depicted embodiments, the first material component is depicted as the outer material component, which directly partially overlaps the second material component positioned as a middle material component, which directly partially overlaps the third material component positioned as the inner material component, in other embodiments the ordering of the material components is altered, such as by positioning the second material component to overlap the first material component (as a middle component) and the third material component. Thus, while certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A garment for nursing and for use with a breast pump, comprising:

at least one seamless cup comprising:

a plurality of at least partially overlapping material components, the plurality of at least partially overlapping material components comprising:

a first material component extending from an upper periphery of the at least one seamless cup toward a lower periphery of the at least one seamless cup, the first material component defining a first free edge adjacent the lower periphery of the at least one seamless cup;

a second material component extending from the lower periphery of the at least one seamless cup toward the upper periphery of the at least one seamless cup, the second material component defining a second free edge adjacent the upper periphery of the at least one seamless cup; and a third material component connected to a shoulder strap of the garment, the third material component extending from the shoulder strap to at least proximate the lower periphery of the at least one seamless cup, the third material component extending from at least proximate a lateral side of the at least one seamless cup toward a medial centerline of the garment, the third material component comprising a material piece folded in half to define a folded edge free of stitching along the folded edge, the folded edge being a medial edge of the third material component, a lateral upper edge of the third material component not affixed to any other material component of the at least one seamless cup.

2. The garment of claim 1, wherein the folded edge is a free edge along a length of the folded edge.

3. The garment of claim 1, wherein:

the first material component and the second material component are releasably attachable to the shoulder strap; and the third material component is affixed to the shoulder strap.

4. The garment of claim 1, wherein:

the first material component is outermost of the plurality of at least partially overlapping material components; and the third material component is innermost of the plurality of at least partially overlapping material components.

5. The garment of claim 1, wherein:

the first material component is outermost of the plurality of at least partially overlapping material components and is directly adjacent the second material component; and the third material component is innermost of the plurality of at least partially overlaping material components and is directly adjacent the second material component.

6. The garment of claim 1, wherein the second material component comprises multiple material layers.

7. The garment of claim 1, wherein the second material component defines the second free edge along a portion of an upper periphery of the second material component.

8. The garment of claim 1, wherein the first material component is affixed to at least a portion of the second material component along at least one portion of the lower periphery of the at least one seamless cup, and wherein the first free edge of the first material component is located along a central portion of the lower periphery of the at least one seamless cup.

9. The garment of claim 1, wherein the first material component is affixed to at least a portion of the second material component along at least one portion of the lower periphery of the at least one seamless cup, and wherein the first free edge of the first material component is located along a central portion of the lower periphery of the at least one seamless cup.

10. A garment for nursing and for use with a breast pump, comprising:

a pair of brassiere cups, at least one brassiere cup of the pair comprising:

a first material component extending from an affixed edge along an upper periphery of the at least one brassiere cup to a free edge that is parallel to a lower periphery of the at least one brassiere cup;

a second material component extending from an affixed edge along the lower periphery of the at least one brassiere cup to a free edge adjacent the upper periphery of the at least one brassiere cup; and a third material component extending from an affixed edge adjacent the lower periphery of the at least one brassiere cup to a shoulder strap of the garment, the third material component comprising a material piece folded in half with material layers of the material piece joined along a folded edge free of stitching, the folded edge being a medial edge of the third material component, the third material component defining a free edge crossing the free edge of the second material component to define a nook, a lateral upper edge of the third material component not affixed to any other material component of the at least one brassiere cup of the pair.

11. The garment of claim 10, wherein the second material component comprises a pair of second material component layers, each of the second material component layers extending from the affixed edge along the lower periphery of the at least one brassiere cup to the free edge adjacent the upper periphery of the at least one brassiere cup, each of the second material component layers defining a respective free layer edge.

12. The garment of claim 9, wherein the folded edge of the third material component forms the free edge of the third material component.

13. The garment of claim 9, wherein the free edge of the first material component is defined as a free edge portion between affixed edge portions joining the first material component to a layer of the second material component.

14. The garment of claim 9, wherein the first material component extends along the entire height of the at least one brassiere cup.

15. The garment of claim 9, wherein the second material component comprises a lateral upper edge unaffixed to the first material component and the third material component.

16. The garment of claim 10, wherein the second material component is directly between the first material component and the third material component.

17. A garment for nursing and for use with a breast pump, comprising:

a pair of shoulder straps;

a rib band; and a pair of brassiere cups, each brassiere cup of the pair of brassiere cups extending from the rib band along a lower periphery of the brassiere cup to one of the pair of shoulder straps at an upper periphery of the brassiere cup, each brassiere cup comprising:

a first seamless material component non-releasably affixed to the one of the pair of shoulder straps, the first seamless material component extending from the one of the pair of shoulder straps to at least proximate the lower periphery of the brassiere cup and defining a first free edge extending perpendicularly, relative to the rib band, from the lower periphery to the upper periphery of the brassiere cup, the first seamless material component comprising a folded-over material piece folded in half and having a folded edge, free of stitching, the folded edge forming the first free edge, a lateral upper edge of the first seamless material component not affixed to any other material component of the brassiere cup of the pair of brassiere cups; and at least two other seamless material components selectively connected to the one of the pair of shoulder straps, the at least two other seamless material components overlapping the first seamless material component and comprising:

a second seamless material component extending from the upper periphery of the brassiere cup toward a second free edge of the second seamless material component, the second free edge being located adjacent the lower periphery of the brassiere cup; and a third seamless material component extending from the lower periphery of the brassiere cup toward a third free edge of the third seamless material component, the third free edge being located adjacent the upper periphery of the brassiere cup.

18. The garment of claim 17, wherein, of the first, second, and third seamless material components:

each second semaless material component is an outer material component;

each third seamless material component is a middle material component directly adjacent the second seamles material component; and each first seamless material component is an inner material component directly adjacent the third seamless material component.

19. The garment of claim 17, wherein, for each brassiere cup, the first free edge of the first seamless material component crosses the third free edge of the middle material component to define a V-shaped nook.

* * * * *